US006626013B2

(12) United States Patent
Ohta et al.

(10) Patent No.: US 6,626,013 B2
(45) Date of Patent: Sep. 30, 2003

(54) WASHING MACHINE, DISPLAY/OPERATION PANEL, AND HOUSEHOLD APPLIANCE WITH THE DISPLAY/OPERATION PANEL

(75) Inventors: Yoshihiro Ohta, Kukizaki (JP); Toshifumi Koike, Chiyoda (JP); Yosuke Nagano, Hitachi (JP); Katuhumi Takagishi, Hitachi (JP)

(73) Assignee: Hitachi, Ltd., Tokyo (JP)

( * ) Notice: Subject to any disclaimer, the term of this patent is extended or adjusted under 35 U.S.C. 154(b) by 176 days.

(21) Appl. No.: 09/841,607

(22) Filed: Apr. 25, 2001

(65) Prior Publication Data

US 2002/0116959 A1 Aug. 29, 2002

(30) Foreign Application Priority Data

Feb. 28, 2001 (JP) ..... 2001-053420

(51) Int. Cl.[7] ..... D06F 33/02
(52) U.S. Cl. ..... 68/12.27
(58) Field of Search ..... 68/12.27

(56) References Cited

FOREIGN PATENT DOCUMENTS

JP 09-084989 * 3/1997

* cited by examiner

*Primary Examiner*—Philip R. Coe
(74) *Attorney, Agent, or Firm*—Antonelli, Terry, Stout & Kraus, LLP

(57) ABSTRACT

A washing machine in which a plurality of display image parts (ID=0 to 9) are disposed and displayed, on the basis of a display/arrangement structure, on the display surface of a display unit in which a transparent pressure-type touch panel is mounted, so as to form a display/operation unit which enables display and operation/instruction by depression. Thus, a user can change the layout of the display/operation unit and washing operations freely.

9 Claims, 24 Drawing Sheets

FIG.11

DATA STRUCTURES OF RESPECTIVE DISPLAY IMAGE PART ITEMS

| ITEM SORT | INFORMATION | |
|---|---|---|
| FRAME | DISPLAY FLAG (0 OR 1) | |
| | IMAGE DATA INFORMATION | |
| | POINTER TO CHILD ITEM | |
| INDICATOR | CURRENT NO. (0,1 · · · N) | |
| | CURRENT NO.0 | TRANSPARENT IMAGE DATA INFORMATION |
| | CURRENT NO.1 | IMAGE DATA INFORMATION |
| | CURRENT NO.2 | IMAGE DATA INFORMATION |
| | ⋮ | |
| | CURRENT NO.N | IMAGE DATA INFORMATION |
| BUTTON | CURRENT NO. (0 OR 1) | |
| | TOUCH AREA INFORMATION | |
| | CURRENT NO.0 | IMAGE DATA INFORMATION |
| | | ACTION SCRIPT |
| | CURRENT NO.1 | IMAGE DATA INFORMATION |
| | | ACTION SCRIPT |
| SELECTOR | CURRENT NO. (1 · · · N) | |
| | TOUCH AREA INFORMATION | |
| | CURRENT NO.1 | IMAGE DATA INFORMATION |
| | | ACTION SCRIPT |
| | CURRENT NO.2 | IMAGE DATA INFORMATION |
| | | ACTION SCRIPT |
| | ⋮ | |
| | CURRENT NO.N | IMAGE DATA INFORMATION |
| | | ACTION SCRIPT |

| | |
|---|---|
| IMAGE DATA INFORMATION | DISPLAY POSITION (X,Y) |
| | SIZE |
| | START ADDRESS OF DOT PICTURE IMAGE DATA |

| | |
|---|---|
| TOUCH AREA INFORMATION | POINTED POSITION (X,Y) |
| | SIZE |

FIG.15

FRAME ITEM

| NAME | ID | INFORMATION | | |
|---|---|---|---|---|
| FULL BACKGROUND | 0 | DISPLAY FLAG | 1 | |
| | | IMAGE DATA INFORMATION | (0,0) | (600,150) |
| | | | START ADDRESS OF FULL BACKGROUND IMAGE | |
| | | CHILD POINTER | POINTER TO LEFT BACKGROUND | |
| | | | POINTER TO RIGHT BACKGROUND | |
| LEFT BACKGROUND | 1 | DISPLAY FLAG | 0 | |
| | | IMAGE DATA INFORMATION | (0,0) | (150,150) |
| | | | START ADDRESS OF LEFT BACKGROUND IMAGE | |
| | | CHILD POINTER | POINTER TO STEP DISPLAY | |
| | | | POINTER TO FIGURE DISPLAY | |
| | | | POINTER TO UNIT DISPLAY | |
| RIGHT BACKGROUND | 2 | DISPLAY FLAG | 1 | |
| | | IMAGE DATA INFORMATION | (151,0) | (400,150) |
| | | | START ADDRESS OF RIGHT BACKGROUND IMAGE | |
| | | CHILD POINTER | POINTER TO START BUTTON | |
| | | | POINTER TO LIGHT BUTTON | |
| | | | POINTER TO STANDARD BUTTON | |
| | | | POINTER TO HEAVY BUTTON | |

INDICATOR ITEM

| NAME | ID | INFORMATION | | |
|---|---|---|---|---|
| STEP DISPLAY | 3 | CURRENT NO. | 0 | |
| | | CURRENT NO.0 | (10,100) | (40,30) |
| | | | START ADDRESS OF TRANSPARENT IMAGE | |
| | | CURRENT NO.1 | (10,100) | (40,30) |
| | | | START ADDRESS OF IMAGE "WASHING" | |
| | | CURRENT NO.2 | (10,100) | (40,30) |
| | | | START ADDRESS OF IMAGE "DETERGENT" | |
| | | ⋮ | | |
| FIGURE DISPLAY | 4 | CURRENT NO. | 0 | |
| | | CURRENT NO.0 | (60,100) | (40,20) |
| | | | START ADDRESS OF TRANSPARENT IMAGE | |
| | | CURRENT NO.1 | (60,100) | (40,20) |
| | | | START ADDRESS OF IMAGE "6" | |
| | | CURRENT NO.2 | (60,100) | (40,20) |
| | | | START ADDRESS OF IMAGE "42" | |
| | | ⋮ | | |
| UNIT DISPLAY | 5 | CURRENT NO. | 0 | |
| | | CURRENT NO.0 | (110,100) | (40,20) |
| | | | START ADDRESS OF TRANSPARENT IMAGE | |
| | | CURRENT NO.1 | (110,100) | (40,20) |
| | | | START ADDRESS OF IMAGE "kg" | |
| | | CURRENT NO.2 | (110,100) | (40,20) |
| | | | START ADDRESS OF IMAGE "g" | |
| | | CURRENT NO.3 | (110,200) | (40,20) |
| | | | START ADDRESS OF IMAGE "min" | |
| | | ⋮ | | |

BUTTON ITEM

| NAME | ID | INFORMATION | | |
|---|---|---|---|---|
| START BUTTON | 6 | CURRENT NO. | 0 | |
| | | TOUCH AREA | (49,4) | (11,11) |
| | | CURRENT NO.0 | (490,40) | (110,110) |
| | | | "START" OUTLINE, "PAUSE" BLACK START ADDRESS OF BUTTON IMAGE | |
| | | | {PAUSE} | |
| | | CURRENT NO.1 | (490,40) | (110,110) |
| | | | "START" BLACK, "PAUSE" OUTLINE START ADDRESS OF BUTTON IMAGE | |
| | | | {START} | |
| HEAVY BUTTON | 7 | CURRENT NO. | 0 | |
| | | TOUCH AREA | (26,6) | (8,9) |
| | | CURRENT NO.0 | (260,60) | (80,90) |
| | | | "HEAVY" OUTLINE START ADDRESS OF BUTTON IMAGE | |
| | | | { } | |
| | | CURRENT NO.1 | (260,60) | (80,90) |
| | | | "HEAVY" BLACK START ADDRESS OF BUTTON IMAGE | |
| | | | {HEAVY-DIRT-WASH} | |
| STANDARD BUTTON | 8 | CURRENT NO. | 0 | |
| | | TOUCH AREA | (35,6) | (8,9) |
| | | CURRENT NO.0 | (350,60) | (80,90) |
| | | | "STANDARD" OUTLINE START ADDRESS OF BUTTON IMAGE | |
| | | | { } | |
| | | CURRENT NO.1 | (350,60) | (80,90) |
| | | | "STANDARD" BLACK START ADDRESS OF BUTTON IMAGE | |
| | | | {STANDARD-WASH} | |
| LIGHT BUTTON | 9 | CURRENT NO. | 0 | |
| | | TOUCH AREA | (44,6) | (8,9) |
| | | CURRENT NO.0 | (440,60) | (80,90) |
| | | | "LIGHT" OUTLINE START ADDRESS OF BUTTON IMAGE | |
| | | | { } | |
| | | CURRENT NO.1 | (440,60) | (80,90) |
| | | | "LIGHT" BLACK START ADDRESS OF BUTTON IMAGE | |
| | | | {LIGHT-DIRT-WASH} | |

FIG.16

EXAMPLE OF ACTION SCRIPT

| ITEM SORT | ACTION SCRIPT |
|---|---|
| BUTTON | {START} |
| | {PAUSE} |
| | {HEAVY-DIRT-WASH} |
| | {STANDARD-WASH} |
| | {LIGHT-DIRT-WASH} |
| | ⋮ |
| | {WASH 8MIN TIME-LIMIT 1.2-1.2 150RPM} |
| | {RINSE 4MIN TIME-LIMIT 1.0-1.0 120RPM} |
| | ⋮ |
| SELECTOR | {BATHWATER NO} |
| | {BATHWATER WASH} |
| | {BATHWATER RINSE-1} |
| | {BATHWATER RINSE-2} |
| | {HANDMADE-WASH} |
| | {BEDDING-WASH} |
| | {HURRY-WASH} |
| | {HARD-RUB-WASH} |
| | {WASH 3MIN} |
| | {RINSE ONCE} |
| | ⋮ |
| | {LEFT-BACKGROUND(ID=13) SET} |
| | {LEFT-BACKGROUND(ID=13) CLEAR} |
| | ⋮ |
| | {ID=15 SET-CURRENT-NUMBER-1} |
| | ⋮ |

EXAMPLE OF WASH STEP INFORMATION

| |
|---|
| {INITIALIZE} |
| {EEPROM STANDARD-WASH} |
| {WASHING 6 kg} |
| {DETERGENT 42 g} |
| {ERROR C2} |
| ⋮ |
| {TERMINATE} |
| {RECEIVE-DATA} |
| ⋮ |

WASHING MACHINE, DISPLAY/OPERATION PANEL, AND HOUSEHOLD APPLIANCE WITH THE DISPLAY/OPERATION PANEL

BACKGROUND OF THE INVENTION

The present invention relates to a display/operation panel the layout of which can be changed freely by a user, and a washing machine mounted with the display/operation panel.

Full automatic washing machines which perform all the steps of washing automatically are mainstream as household washing machines. If a user presses a start button of such a full automatic washing machine, the washing machine estimates the amount of inputted washing, supplies necessary water, washes and dehydrates the washing on standard conditions which are prepared for the washing machine in advance. However, some pieces of washing do not suit such a washing manner which is the same all the time. Therefore, a plurality of operation buttons are provided so that washing courses can be selected in accordance with the kind of washing. Even in a standard course in which washing is performed on standard conditions, various conditions such as the time to wash, the number of times of rinsing, the time to dehydrate, and so on, can be set selectively.

With addition of a large number of functions to washing machine, a larger number of operation buttons and smaller printed characters have been arranged in a limited area on a display/operation panel for carrying out display and operation. Thus, it becomes difficult to read the characters and operate the operation buttons.

As a background art to solve such a problem, JP-A-9-84989 discloses a washing machine. In this washing machine, a display/operation panel in which a touch panel is disposed on a liquid crystal display is provided. Guide display for guiding instruction/operation and status display for showing a present status about the instruction/operation are made on the liquid crystal display. The shapes, sizes and positions of the guide display and the status display are defined in accordance with every screen to be displayed on the liquid crystal display. Screen data for all the display area of the liquid crystal display are prepared in the unit of screen so as to include image data of the guide display and the status display. A user touches the guide display to change over the data screen from one to another. Then, the user touches a desired one of a plurality of key areas (setting item display) displayed on the screen so as to set washing conditions and so on. In such a manner, the user sets the washing conditions and so on.

This is a so-called menu input system. That is, the user changes over the screen one after another as if the user turns over pages. When the user reaches a desired screen, the user touches a setting item display shown on the screen so as to input the washing operation, the washing conditions, and so on.

In the above-mentioned background art, a plurality of screen data for all the display area of the liquid crystal display are prepared in accordance with every screen. As a result, the memory capacity required for storing the screen data increases so that the memory capacity built in a microprocessor cannot cover all the screen data. Thus, an expensive external memory is needed.

Further, the shapes, sizes and positions of the guide display and the status display are determined in advance. Accordingly, in the case where a new washing function is to be added later, it is not easy to add and display the new washing function. In addition, it is not easy to change display characters and key areas to be displayed larger, or to delete unnecessary display characters or key areas from any screen.

Such a request of changing the display or the key area is required when the user becomes aged so that it is difficult for the user to read characters; when the user wants to change the arrangement design of the guide display or the status display because of personal preference; when the user wants to reverse the right and the left in the arrangement because of the user's left-handed problem; or the like.

In addition, various functions are prepared in the washing machine to meet various requests of users. However, all the users do not use all the prepared functions. If display for unused functions is also made on the display/operation panel, or if key areas for unused functions are also provided on the display/operation panel, such unused functions obstruct effective use of the display area of the display/operation panel. Further, function selection (instruction/operation) may be complicated, a false operation may be caused, or the user may be confused. It is therefore preferable that display or key area is set into the functions required by the user. Also in this case, it is preferable that a series of display or key area setting associated with the functions required by the user are performed automatically without any conflict with one another.

SUMMARY OF THE INVENTION

It is an object of the present invention that capacity for display data on a display/operation panel can be reduced and a partial change in display contents of any screen displayed on the display/operation panel can be made easily.

Further, it is another object of the present invention to provide a convenient household appliance including a washing machine by realizing a display/operation panel which meets user's demands in accordance with the aforementioned object.

Respective items displayed on the display/operation panel in which a pressure-type touch panel is disposed on the display surface are treated as parts (display image parts).

The relationship among a plurality of display image parts displayed on one screen is set as a display arrangement structure. Such a display arrangement structure may be specifically described as a tree structure which sets dependent and parallel relations of the respective display image parts.

Each display image part has information which is set with respect to display and operation. Specifically, the information for display may be constituted by image data information such as display position, size, start address of dot picture image data, etc., and specific dot picture image data. As for the information for operation, any item (display image part) having a key area (touch area) may be specifically described as an action script which instructs touch area information of the position and size of a touch area, and operation, together with the information for display.

A plurality of display arrangement structures are prepared in advance. By selecting one of the display arrangement structures, it is possible to make a desired display on the display/operation panel. In this case, it is not necessary to store information repeatedly about display image parts common to respective display arrangement structures. In addition, it is possible to change the layout on the display/operation panel easily by changing the display arrangement structure, or by preparing different display image parts.

If addition, deletion or modification is allowed to be made upon such prepared display arrangement structures or display image parts, it is possible to perform a different display later. Accordingly, a latest display improved in convenience of use can be performed on the display/operation panel, or washing and dehydrating operation suitable for new detergent or new clothes can be set and carried out.

According to the present invention, it is possible to reduce capacity for display data on the display/operation panel, and it is possible to easily make a partial change in the display contents of any screen displayed on the display/operation panel. In addition, it is possible to realize a display/operation panel meeting a user's demand. Thus, it is possible to provide a convenient household appliance including a washing machine.

BRIEF DESCRIPTION OF THE DRAWINGS

FIG. 11 is a table showing data structures of display image part items;

FIG. 15 is a detailed table showing data structures of part items in the first display/operation panel layout;

FIG. 16 is a table showing an example of action script;

DETAILED DESCRIPTION OF EMBODIMENTS

Figure 1:
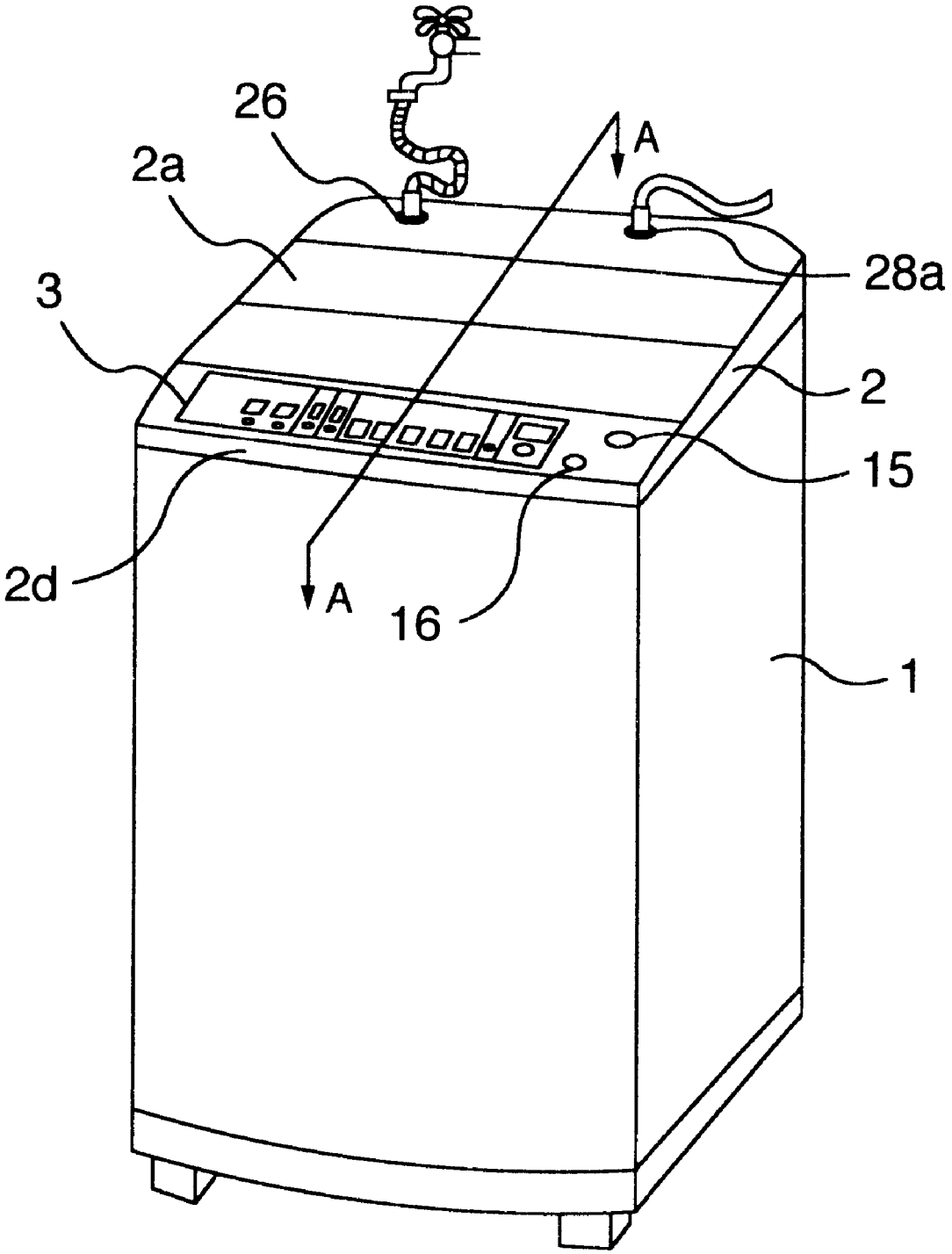
FIG. 1 is a perspective view showing the external appearance of a full automatic washing machine according to the present invention.
Figure 2:
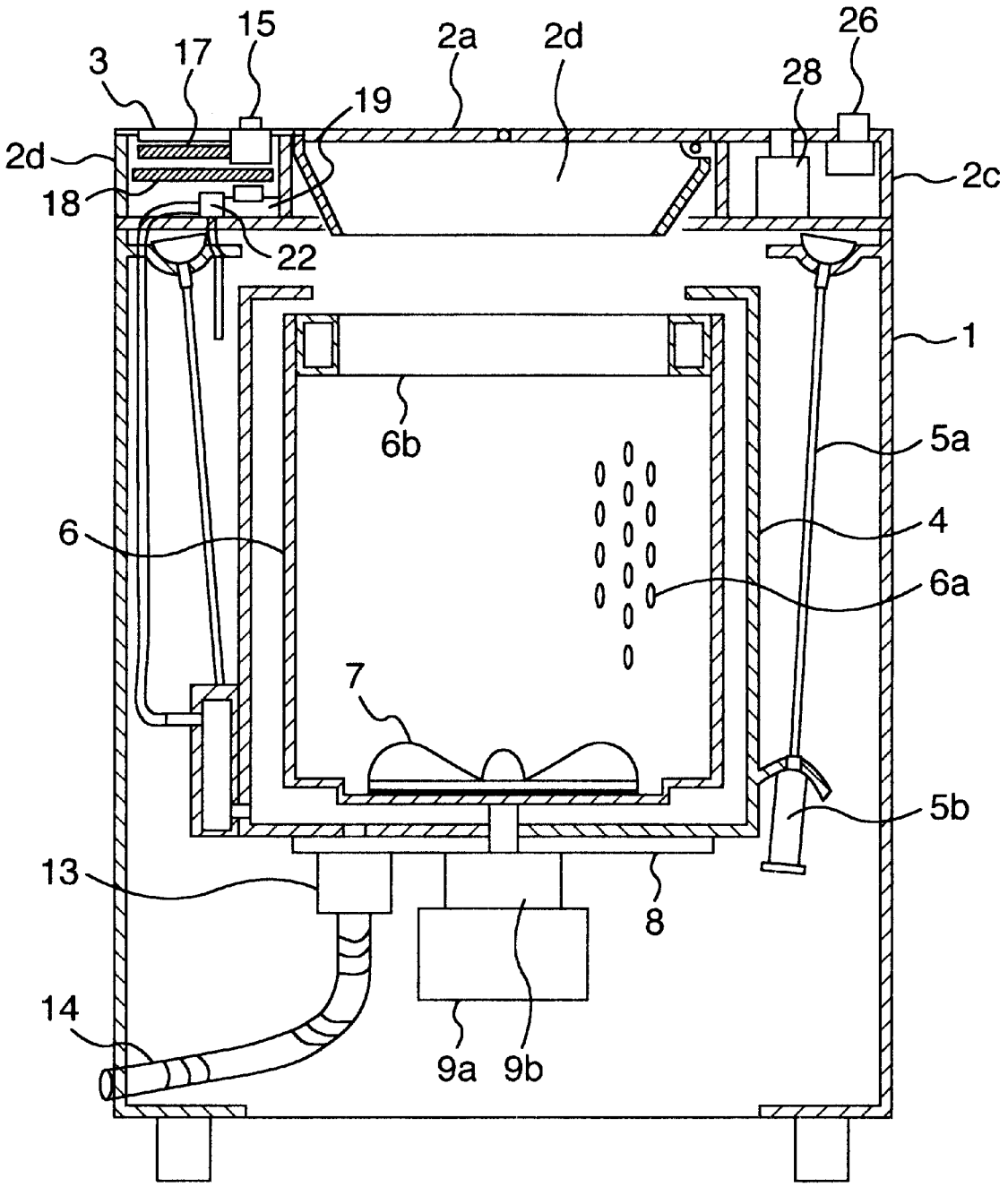
FIG. 2 is a longitudinally sectional view of the full automatic washing machine according to the present invention.

Embodiments of the present invention will be described below with reference to the drawings. FIG. 1 is a view showing the external appearance of a full automatic washing machine according to the present invention. FIG. 2 is a longitudinally sectional view taken on line A—A in FIG. 1. The exterior of the washing machine is constituted by an outer frame 1 made of a steel plate and a top cover 2 attached to the upper portion of the outer frame 1.

The top cover 2 is constituted by a cover 2*a*, an input port 2*b* for inputting washing, a rear storage box 2*c* for storing parts chiefly concerned with water supply, and a front operation box 2*d* for chiefly storing electric parts. A display/operation panel 3, a power switch 15 and a display/operation panel layout selection switch 16 (which may be hereinafter abbreviated to "selection switch") are disposed on the top surface of the front operation box 2*d*.

An outer tub 4 which is a water catch tub is supported by hanging bars 5*a*, and vibration isolators 5*b* constituted by coil springs or sliding rings respectively, so that the outer tub 4 is hung inside the outer frame 1 from the four upper corners of the outer frame 1. The outer tub 4 reserves wash water in a washing step and rinse water (hereinafter also referred to as "wash water") in a rinsing step. A washing/dehydrating tub 6 (hereinafter referred to as "washing tub") made of stainless steel is provided rotatably in the outer tub 4. A large number of dehydrating holes 6*a* are provided in the side surface of the washing tub 6. Balancers 6*b* are provided in the upper edge portion of the washing tub 6. In addition, rotor blades 7 are provided rotatably in the center bottom portion of the washing tub 6. A support plate 8 is attached to the outside of the bottom of the outer tub 4. A drive unit 9 is fixed to the support plate 8.

The drive unit 9 is constituted by an inner-rotor-type DC brushless motor 9*a*, and a transmission device 9*b* in which a gear reducer mechanism and a clutch mechanism are incorporated. The DC brushless motor 9*a* is disposed under the transmission device 9*b*. The input shaft of the transmission device 9*b* is fastened to the rotation shaft (rotor) of the DC brushless motor 9*a*. The transmission device 9*b* has two coaxial output shafts. The rotation of the DC brushless motor 9*a* is transmitted to only one of the two output shafts by the clutch mechanism (not shown) in the device 9*b*. The two output shafts of the transmission device 9*b* penetrate the bottom wall of the outer tub 4 watertightly and project into the outer tub 4, and are coupled with the rotor blades 7 and the washing tub 6 respectively. In the washing step and the rinsing step, the drive unit 9 makes the washing tub 6 stationary, and makes the gear reducer mechanism of the transmission device 9*b* reduce the rotation of the DC brushless motor 9*a* so as to rotate the rotor blades 7 clockwise (forward) and counterclockwise (backward). In the dehydrating step, the drive unit 9 transmits the rotation of the DC brushless motor 9*a* to the washing tub 6 without making the gear reducer mechanism reduce the rotation, so as to rotate the washing tub 6 unidirectionally.

A drain valve 13 for draining wash water is provided at the bottom of the outer tub 4. The wash water is drained to the outside of the washing machine through a drain hose 14 connected to the drain valve.

Figure 3:
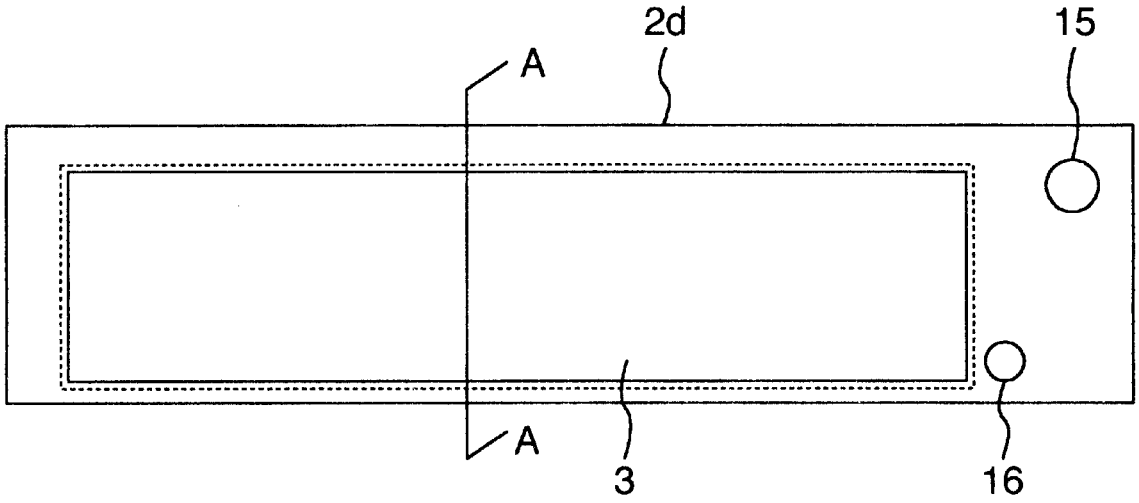
FIG. 3 is a plan view of a front operation box.

FIG. 3 shows the details of the top surface of the front operation box 2*d*. The display/operation panel 3 which is a main part of the present invention occupies the greater part of the top surface. The power switch 15 is disposed at the right end while the display/operation panel layout selection switch 16 is disposed on the just right of the display/operation panel 3. As shown in FIG. 3, the display/operation panel 3 is disposed to occupy the greater part of the front surface of the front operation box 2*d*. For example, the display/operation panel 3 is formed into a rectangular shape having an available display and pressure detection area about 60 mm long×240 mm wide.

Figure 4:
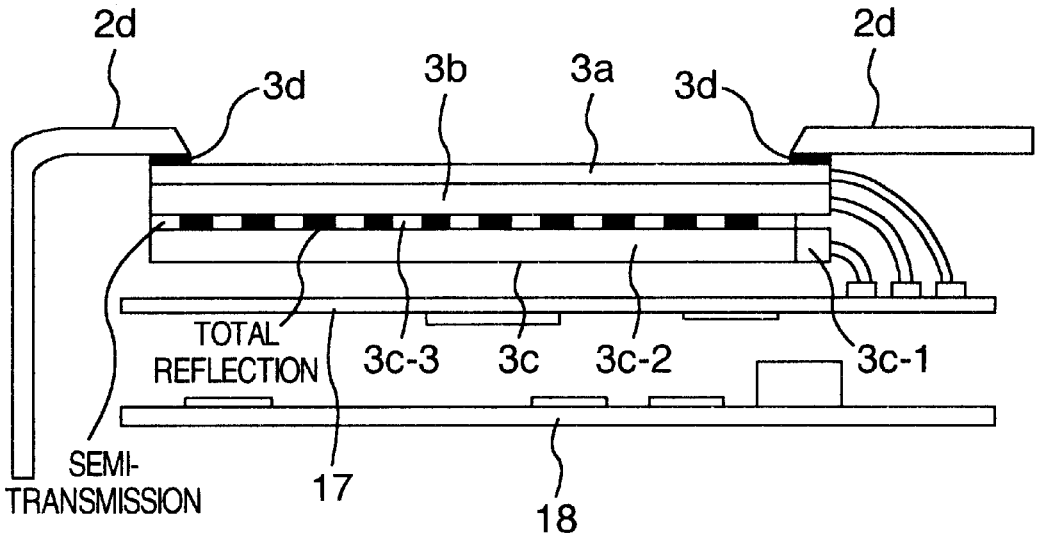
FIG. 4 is a sectional view of the front operation box.

FIG. 4 shows a sectional view taken on line A—A in FIG. 3. The display/operation panel 3 is constituted by a pressure-type touch panel 3*a* for making instruction/operation and a liquid crystal display panel 3*b* for displaying image data. The pressure-type touch panel 3*a* is placed on the uppermost surface, while the liquid crystal display panel 3*b* is formed like a panel just under the pressure-type touch panel 3*a*. The liquid crystal display panel 3*b* is preferably a matrix-type one which has a driving circuit capable of color display in the periphery. A backlight 3*c* is disposed under the liquid crystal panel 3*b*. The backlight 3*c* is constituted by a light source 3*c*-1 formed of a cold or hot cathode fluorescent tube or the like, a light guide plate 3*c*-2 for guiding light from the light source to all the back surface of the liquid crystal display panel, and a reflector 3*c*-3 in which a total reflection film and a semi-transmission film are disposed like stripes or a lattice. These three parts 3*c*-1 to 3*c*-3 are formed integrally, and fixed inside the front operation box 2*d* by a seal material 3*d* so as to prevent water drops from entering the inside of the front operation box 2*d*. A display/operation controller board 17 constituted by a second microcomputer and so on is disposed under the display/operation panel 3. Further, a washing step controller board 18 constituted by a first microcomputer and so on is disposed under the display/operation controller board 17.

Figure 5:
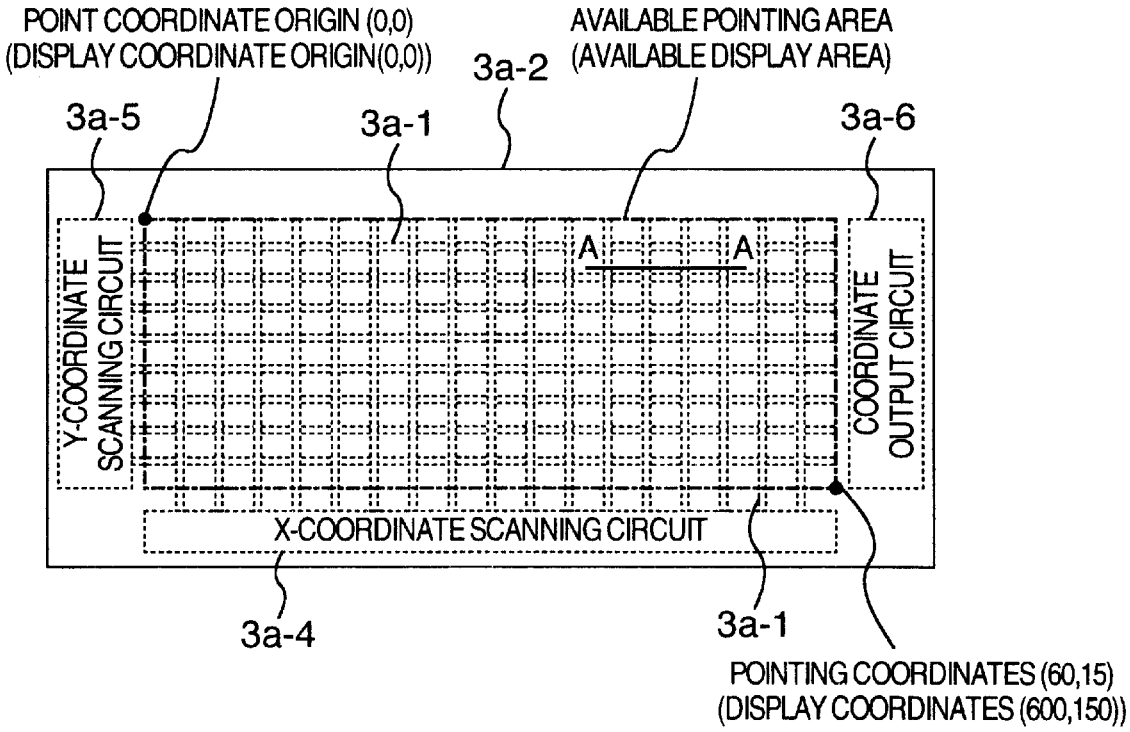
FIG. 5 is a plan view of a pressure-type touch panel.
Figure 6:
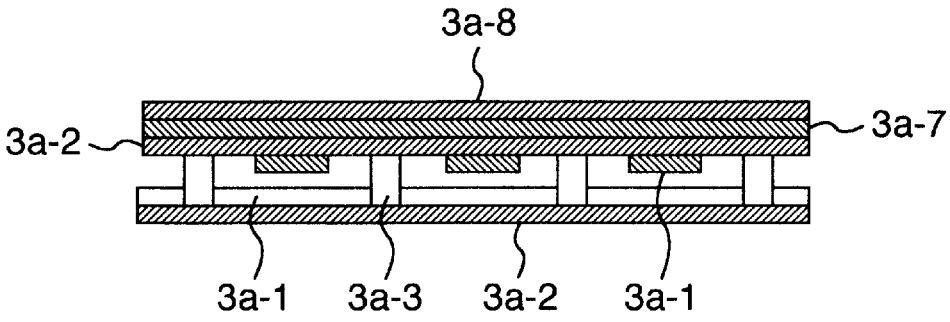
FIG. 6 is a sectional view of the pressure-type touch panel.

FIG. 5 is a plan view showing the pressure-type touch panel 3*a*, and FIG. 6 is a sectional view showing a part of the pressure-type touch panel 3*a* (taken on line A—A in FIG. 5). The pressure-type touch panel 3*a* is formed as follows. That is, two transparent panels 3*a*-2 on which transparent electrodes 3*a*-1 are disposed respectively are formed so that the transparent electrodes 3*a*-1 are in opposition to each other to form a matrix through a plurality of transparent elastic spacers 3*a*-3. For example, the transparent electrodes arrayed longitudinally in FIG. 5 are formed as X electrodes, and the transparent electrodes arrayed transversely in FIG. 5 are formed as Y electrodes. Each of the transparent elastic spacers is disposed substantially at the center of four intersection points among such transparent electrodes.

X and Y coordinate scanning circuits 3*a*-4 and 3*a*-5 and a coordinate output circuit 3*a*-6 are disposed peripherally on one of the transparent panels. The X and Y coordinate scanning circuits 3*a*-4 and 3*a*-5 scan the position where the X and Y electrodes are closed by pressure, respectively. The coordinate output circuit 3*a*-6 outputs pressure position information (XY coordinates) obtained by the scanning. Thus, there appears a pressure-insensible area in the periphery. The area enclosed by the one-dot chain line in FIG. 5 is an available instruction area. Also on the liquid crystal panel 3*b* disposed under the pressure-type touch panel 3*a*, a driving circuit is disposed peripherally likewise. Thus, the liquid crystal display panel 3*b* has an available display area narrower than the panel itself. It is therefore preferable that the pressure-type touch panel 3*a* and the liquid crystal display panel 3*b* are integrated so that their available areas are put on top of each other.

In addition, the surface of the pressure-type touch panel 3*a* is coated with an ultraviolet-curing film 3*a*-7 and a photocatalyst film 3*a*-8 of titanium oxide or the like. The ultraviolet-curing film 3*a*-7 prevents deterioration caused by ultraviolet rays. The photocatalyst film 3*a*-8 automatically removes fingerprint oil stains caused by pressure. Thus, the pressure-type touch panel 3*a* is improved in mar-proof and strengthened against stains.

The reason why the pressure-type touch panel 3*a* is used to detect a touch area through mechanical pressure is as follows. That is, 1) the touch panel is operated by a wet finger when a washing machine is operated; 2) water drops are easy to adhere onto the panel; and 3) washing touches the panel surface when the washing is taken out. There are other types of touch panels such as: an ultrasonic wave type using reflection of a surface ultrasonic wave; an acoustic wave type using reflection of a surface acoustic wave; an electrostatic type using a change of electrostatic capacity in a bonded area; and so on. Such other types of touch panels cannot be used in washing machines because of the above-mentioned reason, that is, because water drops, stains, washing, or the like, touch the surface of the touch panel. In addition, the reason why the display/operation panel 3 is brought into waterproof contact with the front operation box 2*d* by the seal material 3*d* is to prevent water drops from entering and adhering to electric parts on the boards 17 and 18.

In addition, a water level sensor 19, a cover open/close sensor 20, a cover lock mechanism 21 and a tub whirling sensor 22 are provided under the washing step controller board 18 in the front operation box 2*d*. The water level sensor 19 detects the water pressure in the outer tub 4 so as to judge whether water has been reserved to a predetermined level or not. The cover open/close sensor 20 detects the open/close of the cover. The cover lock mechanism 21 puts a hook into a fitting hole of the cover 2*a* opposite to the cover lock mechanism 21 so as to lock the cover to prevent it from opening. The tub whirling sensor 22 is a lever switch operated by the whirling of the outer tub.

A tap water port 26, a water supply electromagnetic valve 27 following the tap 26, and a bathwater feed pump 28 are disposed in the rear storage box 2*c*. A hose from a tap or the like is connected to the tap water port 26. The bathwater feed pump 28 feeds bathwater.

Figure 7:
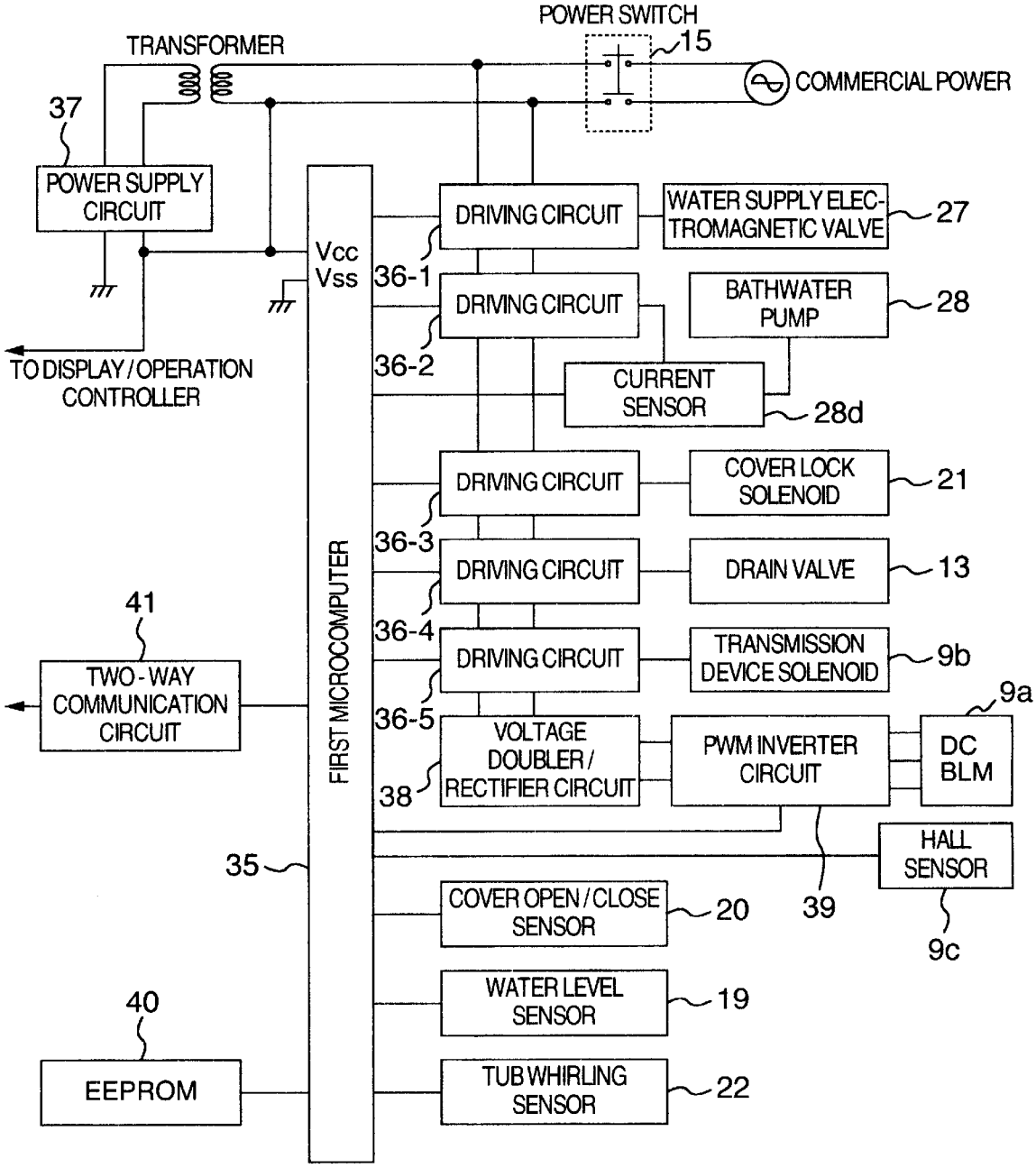
FIG. 7 is a block diagram showing the electric connection of a washing step controller.

FIG. 7 is an electric block diagram showing a washing step controller chiefly constituted by a first microcomputer 35. The output of the microcomputer 35 is connected to a driving circuit 36 (−1, −2, . . . , −5) so as to supply commercial power to the bathwater feed pump 28, the water supply electromagnetic valve 27, the drain valve 13, and so on, and control the open/close or rotation thereof.

A voltage doubler/rectifier circuit 38 connected to the commercial power doubles and rectifies the commercial power so as to generate and supply DC voltage of about 280V to a PWM inverter circuit 39. The PWM inverter circuit 39 supplies a three-phase AC current to respective magnetic field windings of the U, V, and W phases of the DC brushless motor 9*a*.

Three pairs of hall devices 9*c* are built in the DC brushless motor 9*a* as rotor position detection means. The rotor position is detected by the hall devices 9*c* and transmitted to the first microcomputer 35. Then, the first microcomputer 35 operates a PWM signal on the basis of the rotor position and the rotational speed information, and supplies the PWM signal to the PWM inverter circuit 39. The PWM inverter circuit 39 applies a PWM rectangular wave voltage to the respective magnetic field windings of the U, V and W phases of the stator of the DC brushless motor 9*a*. The wave height value of the PWM rectangular wave voltage is substantially equal to an input DC voltage. At this time, currents flowing in the respective windings are formed into sine waves by the inductance and capacitance of the motor winding. That is, three-phase sine wave currents are supplied to the respective windings. If the currents of the U, V and W phases have a phase relationship of 120° in this order, the DC brushless motor 9*a* rotates clockwise. On the contrary, for example, if the UV-phases are reversed in the above-mentioned phase relationship, the DC brushless motor 9*a* rotates counter-clockwise. The speed of rotation of the DC brushless motor 9*a* is controlled by the duty factor of the PWM signal, that is, the conduction ratio thereof.

An EEPROM 40, which is an electrically rewritable ROM, stores chiefly the operation conditions in which washing has been performed before. The first microcomputer 35 can recognize the operation conditions of the washing machine or the values set by the user, from output values of various sensors in the middle of execution of the washing steps. Information, for example, the number of times of washing that has been carried out before, occurrence of failures of mounted electric parts such as breaking of the bathwater feed pump, the set values in washing that the user has carried out (washing course name, existence of bathwater supply, washing time, number of times of rinsing, dehydrating time, etc.), and so on, are stored in the EEPROM 40 whenever washing is carried out. Thus, it is possible to enhance the convenience in the washing steps which will be carried out next time. Such setting can be reflected in the initial screen on the display/operation panel 3 as will be described later.

An internal RQM of the first microcomputer 35 stores a sequence program for controlling the washing steps, a program for driving the brushless motor 9*a*, sequence data, etc.

A two-way communication circuit 41 is connected to a second microcomputer 45 of the display/operation controller. From the second microcomputer 45, the two-way communication circuit 41 receives information such as washing-carrying-out conditions and so on set by the operation of the user. In addition, the two-way communication circuit 41 supplies the second microcomputer 45 with information such as circumstances in the washing steps gathered from the sensors or the like.

Figure 8:
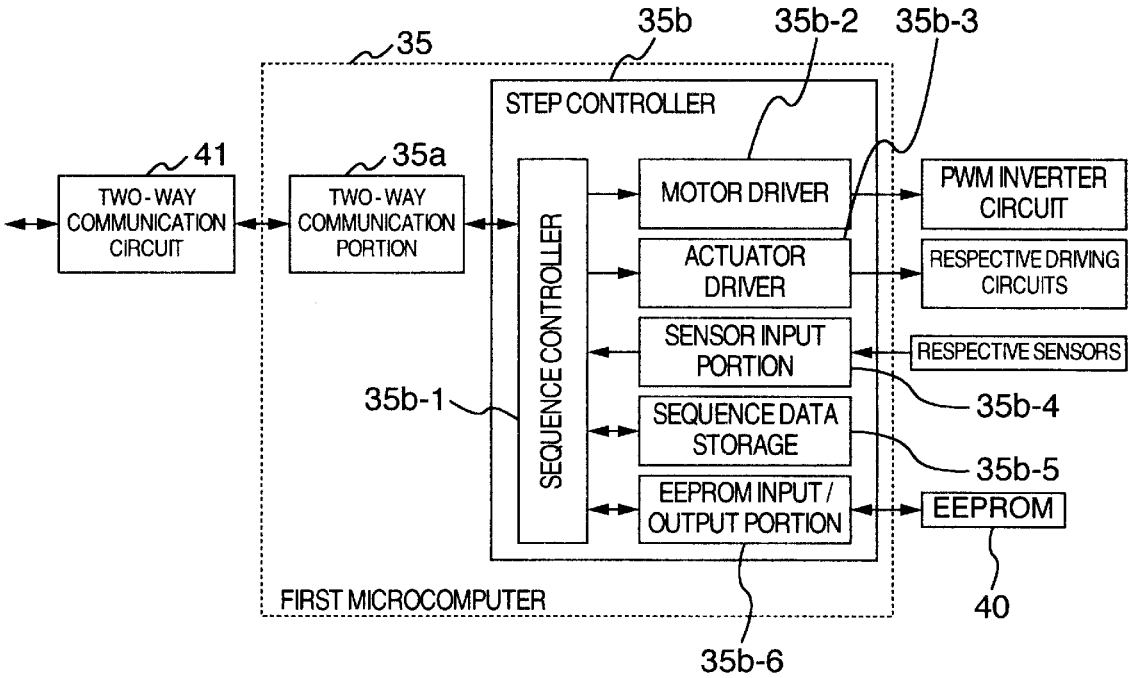
FIG. 8 is a block diagram showing the software of a first microcomputer.

FIG. 8 is a block diagram showing the software configuration written in the internal ROM of the first microcomputer 35. By use of the two-way communication circuit 41, a two-way communication portion 35*a* receives/transmits various kinds of information from/to the second microcomputer 45 in the form of command data. The command data served in the two-way communication includes user's instructions and information in the washing steps. A step controller 35*b* executes a sequence of flow in the washing steps. The user's instruction information is supplied from the second microcomputer 45 of the display/operation controller to the step controller 35*b*, particularly a sequence controller 35*b*-1 through the two-way communication circuit 41 and the two-way communication portion 35*a*, in the form of a command. The sequence controller 35*b*-1 is programmed to read a command received by the two-way communication portion 35*a* at intervals of a fixed time, or to always receive user's instructions in the form of interruption caused by command reception. Such command transmission/reception will be described in detail later. The step controller 35*b* is constituted by a motor driver 35*b*-2, an actuator driver 35*b*-3, a sensor input portion 35*b*-4, a sequence data storage 35*b*-5, and an EEPROM input/output portion 35*b*-6, as well as the sequence controller 35*b*-1 as a main part. The motor driver 35*b*-2 is an inverter for driving the DC brushless motor 9*a*. The actuator driver 35*b*-3 controls various kinds of actuators. The sensor input portion 35*b*-4 monitors the conditions of various kinds of sensors. The sequence data storage 35*b*-5 stores specific sequence data in each washing step. The EEPROM input/output portion 35*b*-6 reads/writes data from/into the EEPROM 40. In response to user's operation through the display/operation controller, the step controller 35*b* starts/stops the washing steps, or changes the set contents of the washing steps and carries out the changed washing steps. In this case, practically, the sequence controller 35*b*-1 reads sequence data for washing steps in accordance with user's instructions from the sequence data storage 35*b*-5. On the basis of the sequence data, the hardware is controlled by use of the motor driver 35*b*-2 and the actuator driver 35*b*-3. Thus, the washing steps are advanced. At this time, data from the respective sensors are read through the sensor input portion 35*b*-4 so that the circumferences are monitored in the middle of execution of the respective washing steps (water feeding, washing, rinsing, dehydrating, and draining). The step controller 35*b* stops the present execution and warns the user if there is a failure, moves to the next step, and informs the user of the termination of the washing steps. Particularly, warning of the user, or the like, is carried out by the display/operation controller, which sends information of warning or the like to the second microcomputer 45 as command data. This operation will be described in detail later.

Figure 9:
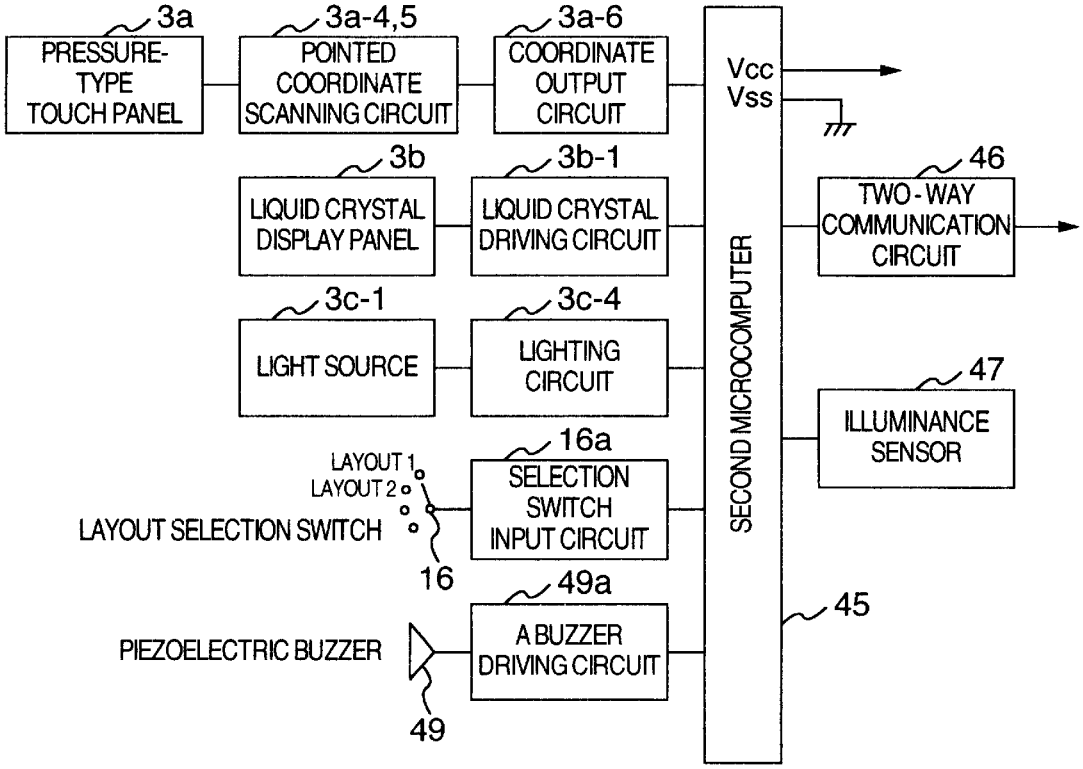
FIG. 9 is a block diagram showing the electric connection of a display/operation controller.

FIG. 9 is an electric block diagram showing the display/operation controller chiefly constituted by the second microcomputer 45. A two-way communication circuit 46 is connected to the two-way communication circuit 41 of the washing step controller. The pressure-type touch panel 3*a* has transparent electrodes disposed in a matrix. XY-coordinate scanning circuits 3*a*-4 and 3*a*-5 detect the position (XY coordinates) where the matrix-like transparent electrodes are brought into a closed state by pressure. A coordinate output circuit 3*a*-6 supplies the XY coordinates from the XY coordinate scanning circuits to the second microcomputer 45. The liquid crystal panel 3*b* displays dot picture image data supplied from the second microcomputer 45 through a liquid crystal driving circuit 3*b*-1. A light source 3*c*-1 such as a cold cathode fluorescent tube, or the like, is lit at a high frequency by a lighting circuit 3*c*-4. Thus, the light source 3*c*-1 has a function as backlight illuminating the liquid crystal panel from its back. The pressure-type touch panel 3*a*, the liquid crystal display panel 3*b* and the backlight 3*c* are disposed sequentially in the descending order from the top so that their available touch area, available display area and backlight area are put on top of one another. Thus, an integrated display/operation panel 3 is formed. An illuminance sensor 47 is disposed on the top surface of the front operation box 2*d* (not shown) so as to detect the illuminance on the display/operation panel 3. This is because the lighting of the backlight 3 is controlled in accordance with the illumination condition of the display/operation panel 3. If the illuminance on the panel is sufficient, the backlight 3 is turned off. If the illuminance is insufficient, for example, at night, the backlight 3 is turned on to improve the visibility of the liquid crystal display. To enhance the visibility, of course, the illuminance sensor may be omitted to always turn on the light source. A display/operation panel layout selection switch 16 selects one from a plurality of display arrangement structures (specifically tree structure data, which will be described in detail later, also referred to as "display/operation panel layout data) stored in a ROM of the second microcomputer 45 in advance. A selection switch input circuit 16*a* reads the contents of the selection switch. The reference numeral 49 represents a piezoelectric buzzer, and 49*a*, a driving circuit thereof. As will be described in detail later, the piezoelectric buzzer 49 generates an electronic sound in response to the pressure applied onto any button image displayed on the liquid crystal panel 3*b*, or generates an electronic sound for warning or informing the user of an error detected in various kinds of sensors of the washing step controller.

Figure 10:
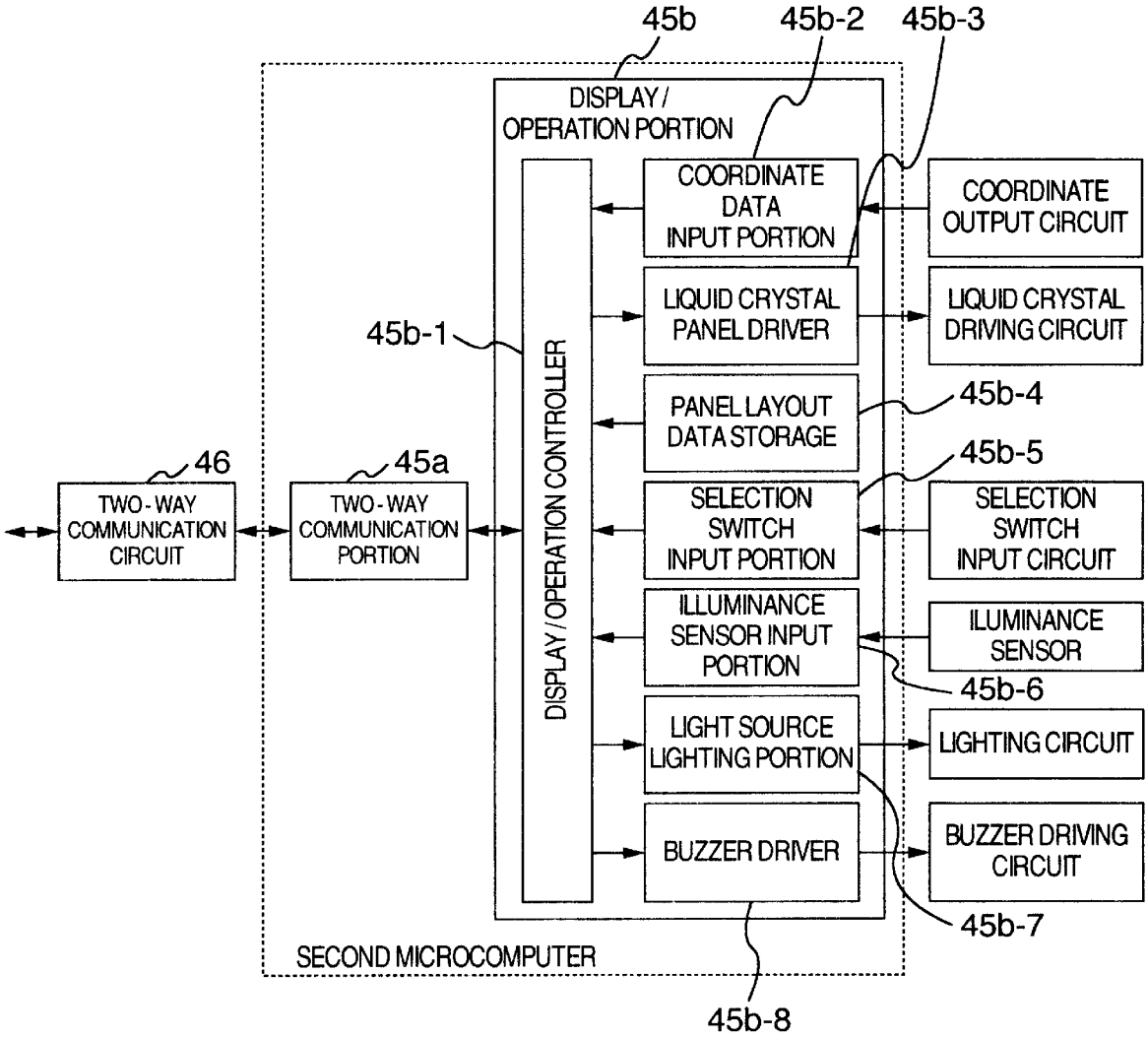
FIG. 10 is a block diagram showing the software of a second microcomputer.

FIG. 10 is a block diagram showing the software configuration of the second microcomputer 45. By use of the two-way communication circuit 46, a two-way communication portion 45*a* receives/transmits user's instruction information, washing step information, and so on, from/to the first microcomputer 35 in the form of command data. A display/operation portion 45*b* executes a sequence of flow for display on the liquid crystal panel 3*b* and acceptance of user's washing instructions through the pressure of the pressure-type touch panel 3*a*. The user's instructions are sent to the first microcomputer 35 through the two-way communication portion 45*a* by the two-way communication circuit 46. On the other hand, the washing step information from the first microcomputer 35 is interpreted by the display/operation portion 45*b* and displayed on the liquid crystal panel 3*b*.

The display/operation portion 45*b* is chiefly constituted by a display/operation controller 45*b*-1 for controlling the display/operation panel 3. The display/operation controller 45*b*-1 reads, from a panel data storage 45*b*-4, the display arrangement structure (specifically tree structure data, which will be described in detail later, also referred to as "display/operation panel layout data) selected by the user through the selection switch 16. The display/operation portion 45*b* controls a liquid crystal panel driver 45*b*-3 so as to display the read display arrangement structure on the liquid crystal panel 3*b*. Coordinates on the touch panel 3*a* pressed by the user are supplied to the display/operation controller 45*b*-1 through the coordinate output circuit 3*a*-6 and a coordinate data input portion 45*b*-2. On the basis of the coordinates, the display/operation portion 45*b* detects instructions on display button images which will be described later.

An illuminance sensor input portion 45*b*-6 reads the value of the illuminance sensor. In accordance with this value, the display/operation controller 45*b*-1 controls a light source lighting portion 45*b*-7 so as to turn on/off the backlight 3*c*. A buzzer driver 45*b*-8 makes up a buzzer driving waveform, and drives the buzzer circuit 49*a* to sound the piezoelectric buzzer 49. This sound is made, for example, as a reaction to the user when the coordinate data input portion 45*b*-2 accepts the coordinates of the touch area pressed by the user, which will be described later, or as a warning sound from the first microcomputer 35 when something is wrong in the washing steps.

Next, detailed description will be made about a method of desired display on the display/operation panel 3, which is the primary object of the present invention, and a method of operating the washing machine through the pressure of the user on the panel.

To make up a plurality of display image layouts and a plurality of operation methods on the display/operation panel 3 in this embodiment, display images are formed as parts, and the parts are disposed and displayed on the liquid crystal panel 3*b*. Display data are dot picture image data which express pictures and characters by use of a plurality of so-called display dots (pixels). The display image parts include not only address information (pointers) to the dot picture image data but also function information. Items of the display image parts include:

1) A part item (hereinafter referred to as "frame item") for forming a background for other image parts;
2) A part item (hereinafter referred to as "indicator item") for carrying out dynamic display of variables (characters and figures) on the frame;
3) A part item (hereinafter referred to as "button item") in which a touch area can be set as a target of operation and the state of which is switched between ON and OFF by the operation of the touch area; and
4) A part item (hereinafter referred to as "selector item") in which a touch area can be set as a target of operation and which has N kinds of states one of which can be selected exclusively by the operation of the touch area.

These items are designed to have the following properties respectively.

1) Frame item: This is the only item that can have child items. Display is controlled by each frame item. Child frame items may be pasted onto the frame item. Structurally, each frame item has one image data, a display flag for controlling display, and pointers to the child items.
2) Indicator item: This is an item for dynamic display of variables on the frame. Any indicator item is used for displaying figures, characters, etc. Structurally, each indicator item has a plurality of image data information. The image data information includes one transparent image data information so that blinking display can be carried out.
3) Button item: This is an item that has ON and OFF faces, and has one touch area information. If this area is pressed, the button item changes the corresponding image display from the ON face to the OFF face or from the OFF face to the ON face. Then, the operation (action script) described in the item is interpreted and executed. Structurally, each button item has two image data information for the ON and OFF faces and two operation information (action script).
4) Selector item: This is an item that has one touch area and a plurality (N) of faces. The status keeps one status exclusively, and displays the $i^{th}$ image. If the item is touched, the item changes the display from the $i^{th}$ image to the $(i+1)^{th}$ image. Then, the $(i+1)^{th}$ described operation (action script) is interpreted and executed. If i reaches N or more, the item operates cyclically (returns to the initial). Structurally, each selector item has N pieces of image data information, N pieces of operation information and one touch area information.

A plurality of display image parts are grouped into each item. Name, ID, size, image data information and operation information (action script) for every (current) number, display status (current number), function information such as touch area information, and so on, are assigned to each part. FIG. 11 shows data structures of display image parts for every item.

Figure 12:
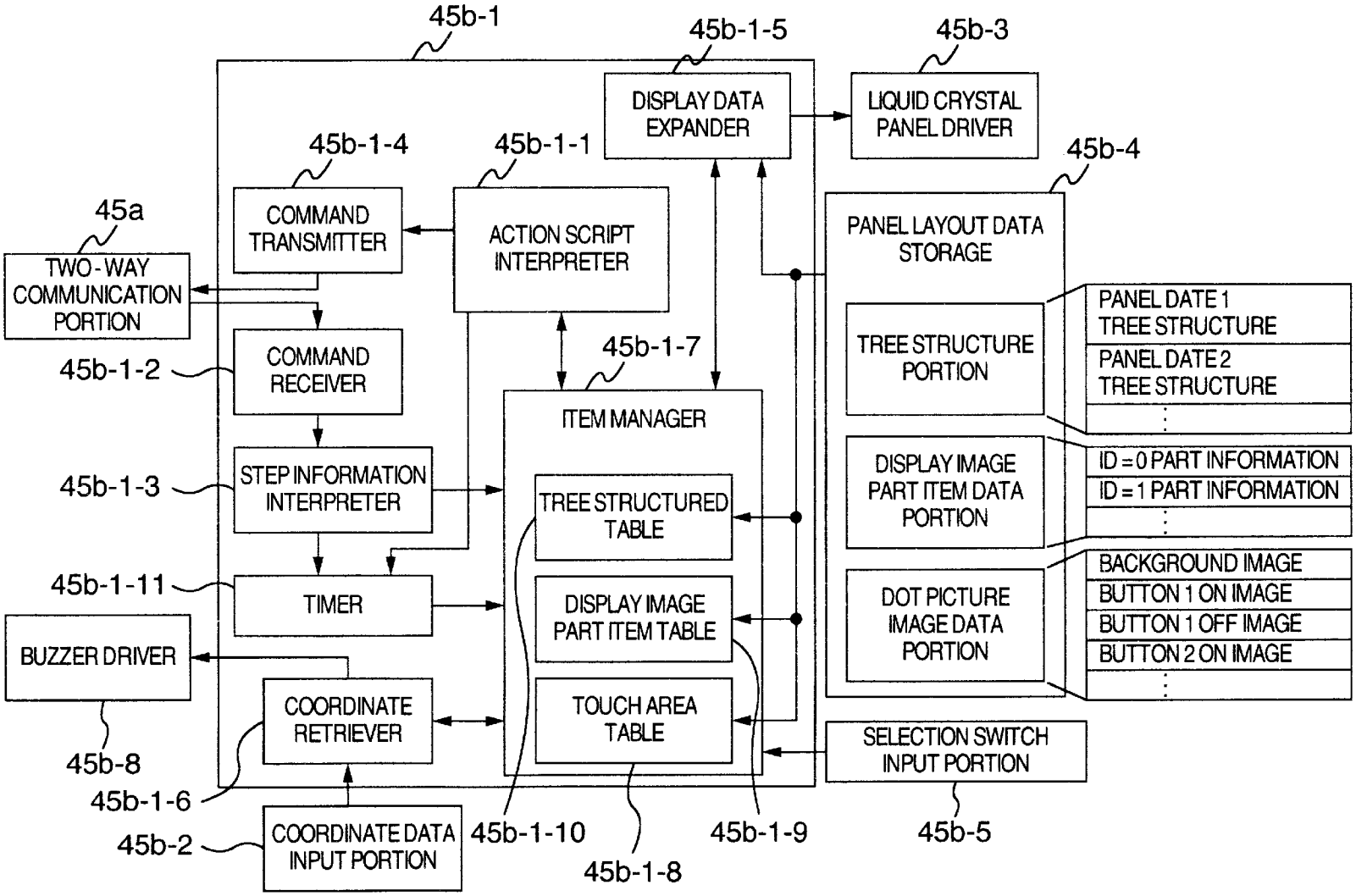
FIG. 12 is a detailed diagram showing a display/operation controller and a display/operation panel layout data storage.

FIG. 12 is a detailed software block diagram showing the display/operation controller 45*b*-1 and the panel data storage 45*b*-4 in FIG. 10. The panel data storage 45*b*-4 is constituted by a tree structure portion, a display image part item data portion, and a dot picture image data portion. The tree structure portion stores a plurality of tree structures, which express the arrangement of display image part item data prepared in advance, in accordance with dependent and parallel relations, respectively. The display image part item data portion stores a plurality of display image part item data in FIG. 11, which are display image parts. The dot picture image data portion stores a plurality of dot picture image data which are made up on the basis of the respective item data so as to be displayed actually.

The display/operation controller 45*b*-1 is constituted by a display data expander 45*b*-1-5, an action scrip interpreter 45*b*-1-1, an item manager 45*b*1-7, a coordinate retriever 45*b*-1-6, a command transmitter 45*b*-1-4, a command receiver 45*b*-1-2, a step information interpreter 45*b*-1-3, and so on. The display data expander 45*b*-1-5 expands dot picture image data over one screen in accordance with a tree structure so as to display the dot picture image data on the liquid crystal panel. The item manager 45*b*-1-7 has temporary storage (RAM) areas, that is, a tree structured table 45*b*-1-10, a display image part item table 45*b*-1-9, and a touch area table 45*b*-1-8.

Figure 13:
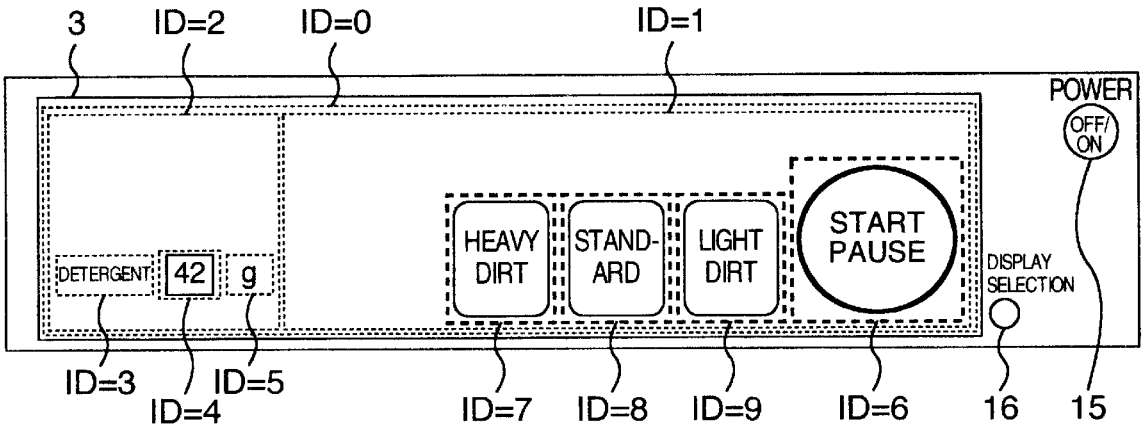
FIG. 13 is a view showing a first display/operation panel layout.

Description will be made below about the display and operation on the basis of a simple example of display/operation panel layout (a first display/operation panel layout) shown in FIG. 13. In FIG. 13, those which are enclosed by the dotted lines (to which different ID numbers are assigned) are display image parts (items) respectively. If the first display/operation panel layout is selected by the selection switch 16, the display/operation panel 3 is laid out in accordance with a tree structure (FIG. 14) corresponding to the first display/operation panel layout as shown in FIG. 13.

Figure 14:
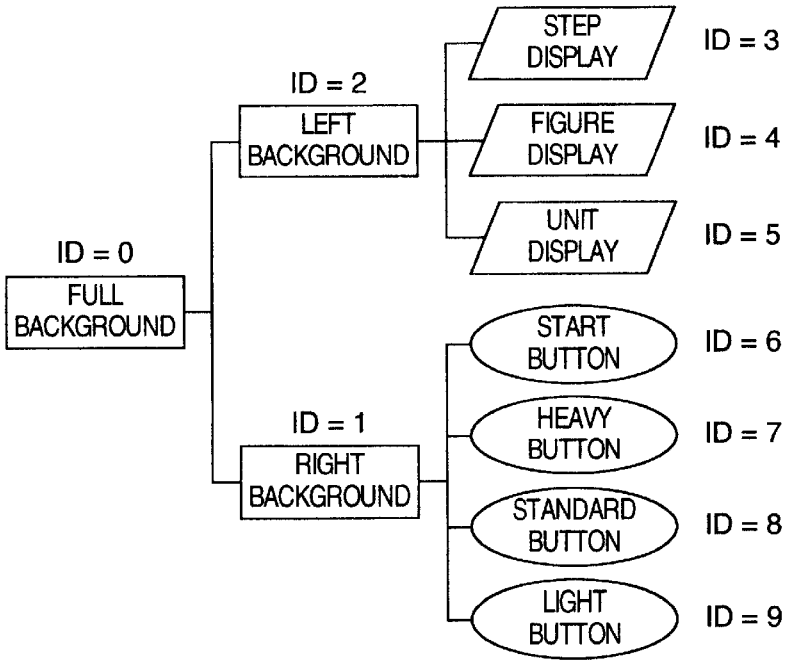
FIG. 14 is a tree structured diagram of the first display/operation panel layout.

FIG. 14 shows the tree structure of this panel screen layout. In FIG. 14, the rectangles designate background items, the parallelograms designate message items, and the ellipses designate button items. The figures beside the items designate IDs. Any tree structure is expressed by ID symbols and connection relations (fraternal one and parent-child one) among item sorts. Parallel relationship designates a fraternal relation, and dependent relationship designates a parent-child relation. A display image part item data is defined for every ID, and stored in the display image part item data portion with a data structure shown in FIG. 11. Image data information of the display image part item data portion includes display position (xy coordinates of the left upper corner), size, and start address of dot picture image data. Specific dot picture data to be displayed is stored in the dot picture image data portion.

FIG. 15 shows examples of specific display image part items in the layout of FIG. 13 in the ascending order of the ID numbers. In each coordinate data, the left upper corner in FIG. 5 is regarded as the origin (0, 0), and the right lower corner is regarded as the point (600, 150). That is, the resolution of the liquid crystal panel is set to be 600 by 150 dots. The resolution of the touch panel is rough, about 1/10 of the resolution of the liquid crystal panel. Coordinates of the touch panel are expressed likewise. That is, the left upper corner is regarded as the origin (0, 0), and the right lower corner is regarded as the point (60, 15). The touch area for the button items enclosed by the dotted line in FIG. 13 corresponds to the area of the image data enclosed by another dotted line.

First, a part named "full background" with ID=0 is prepared as a head frame item. The dot picture image data of the frame item "full background" is a plain dot picture similar to the top surface color of the front operation box 2*d*. Under this frame item, a part named "right background" with ID=1 and a part named "left background" with ID=2 are prepared as child items. The dot picture image data of these items "left background" and "right background are also plain dot pictures similar to the top surface color of the front operation box 2*d*. In the frames of the items "right background" and "left background", respective display image parts are distributed as child items. First, in the "left background", three display image parts named "step display" (ID=3), "figure display" (ID=4) and "unit display" (ID=5) are disposed as indicator items. The item "step display" displays information in the respective washing steps, such as input detergent content, time to the termination, messages for errors or the like. The item "figure display" displays alphanumeric characters. The item "unit display" displays a unit such as kg, min, etc. On the other hand, in the "right background", four display image parts named "start button" (ID=6), "heavy button" (ID=7), "standard button" (ID=8) and "light button" (ID=9) are disposed as button items. The item "start button" issues instructions to start washing or to stop the washing temporarily. The item "heavy button" issues instructions to wash washing which is heavy in dirt. The item "standard button" issues instructions to wash normally. The item "light button" issues instructions to wash washing which is light in dirt. In such a manner, indicator items and button items are disposed on the frame items of "left background" and "right background" as children items so that a tree structure is formed and hence the respective parts are associated with one another. Thus, a plurality of parts are put on frame items, and the respective parts are assembled so that every part is always associated with any one of the frame items as its parent. The built tree structure of the items and the item data of the respective display image parts express a layout of the display/operation panel.

The display image parts associated with one another in accordance with the tree structure as shown in FIG. 14 changes the images in accordance with the operation of pressure by the user or the information from the washing step controller. Such changes of the display images can be classified into two kinds.

1) To change image pointers of items.
2) To remove items from display targets, or to incorporate items into display targets.

Each item is designed to have a plurality of data of images drawn in advance, so that one image can be switched to another. An item has only one of the image data as an exclusive display target. Therefore, there are indicator, button and selector items. Each button item has an OFF image (current number 0) and an ON image (current number 1), and an image to be the display target is designated by the current number. Each of indicator and selector items has N images. When the $i^{th}$ one of the N images is set as a display target, the current number is $\underline{i}$.

Only a frame item has a flag which indicates whether the item should be displayed or not. If a frame item is out of a display target (display flag=0), the frame item itself and all the part items belonging to the frame item are not displayed. Any item that has a plurality of image data information can change over its own display in itself (by its current number). Specifically, the current number is rewritten to change the display. Any item that has a touch area has not only display data but also action instructions described in action script.

Triggers for changing over the screen display of items include pressure on the touch panel disposed on the liquid crystal panel, and information from a timer and the washing step controller.

The touch area table **45*b*-1-8 retains touch area information of button and selector items having touch areas, and examines whether the coordinates on the liquid crystal display pressed by the user belong to any of the touch areas or not. Only touch areas on the current frames (display flag=1) which are targets of display are stored. If the current frames are changed (added or deleted), the touch area information is updated by the item manager 45*b*-1-7**.

When coordinates (x, y) are supplied from the coordinate data input portion **45*b*-2, the coordinate retriever 45*b*-1-6** retrieves which item has a touch area corresponding to the coordinates (x, y). If the corresponding item is present, the ID of the item is sent to the item manager.

The item manager **45*b*-1-7 manages items. The item manager 45*b*-1-7 reads out information of the touched item from the display image part item table 45*b*-1-9 on the basis of the ID of the item. The item manager 45*b*-1-7 gives action script included in the item data to the action script interpreter 45*b*-1-1. Alternatively, in response to the instructions of the interpretation result from the action script interpreter, the item manager 45*b*-1-7 changes the current number of the item data, or changes the status of the item data. For example, the item manager 45*b*-17** removes a frame item from the target of display (display flag=0) or incorporates the frame item into the target of display (display flag=1).

The action script interpreter **45*b*-1-1, which is an interpreter module, interprets descriptors (commands) of the action script. Then, in accordance with the interpretation result, the action script interpreter 45*b*-1-1 gives instructions to the item manager 45*b*-1-7, or sets or refers to the timer 45*b*-1-11. Further, the action script interpreter 45*b*-1-1 gives the command transmitter 45*b*-1-4 a command to be transmitted to the first microcomputer. Those which can describe operation in action script are only the button and selector items each having a touch area. FIG. 16 shows examples of descriptors (commands) prepared for the action script. In FIG. 16, step information to be transmitted from the washing step controller to the display/operation controller is also described in the form of commands. Some commands have arguments, and others do not have any arguments. Although the commands in FIG. 16** are written by words easily to understand, the commands are encoded data actually. Each command is described by a step name executed by the washing step controller and an argument with a space partitioning the step name and the argument. To describe periodical actions, a timer is mounted. The timer is used for blinking display, buzzer sound generating timing, and so on.

Description will be made about the display/operation panel layout in FIG. 13, along its image display transition shown in FIGS. 17A to 17F.

The second microcomputer 45 serves chiefly for changing-over the screen display of display image part items in response to the operation of the user or in accordance with the progress of washing steps. Triggers for changing over the screen display include a coordinate input from the touch panel, washing step information (sensor information, progress conditions, errors) from the first microcomputer 35, and a periodical signal from the timer.

Figure 17A:
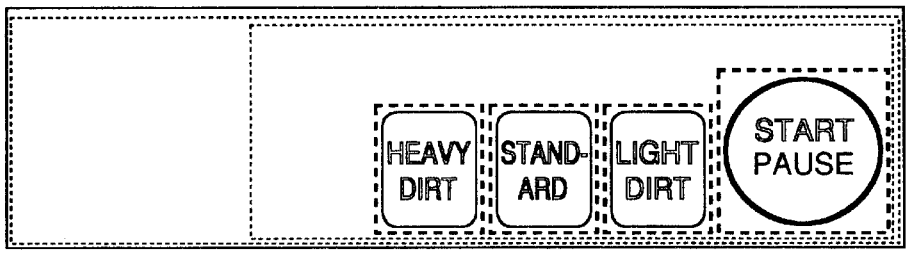
FIGS. 17A to 17F are views showing images of the first display/operation panel layout.

The selection switch 16 is selected to the standard panel layout (first display/operation panel layout) of FIG. 13 (at the time of factory shipment). When the power switch 15 is turned on, the screen shown in FIG. 17A is displayed on the liquid crystal panel **3*b*. When the power is turned on, the first and second microprocessors are reset, and an initialization program is executed. The first microprocessor 35 sends a command {initialize} for initializing panel setting to the second microprocessor 45 as one of the initialization program. In response to this initialization command, the second microprocessor 45 displays the above-mentioned screen of FIG. 17**A.

First, a tree structure selected by the selection switch 16 is read in the tree structured table **45*b*-1-10 in the item manager 45*b*-1-7. Succeedingly, the item manager 45*b*-1-7 retrieves respective item data in the display image part item data portion of the panel data storage on the basis of the IDs of the tree structure, and reads a plurality of necessary display image part item data into the display image part item table 45*b*-1-9. At the same time, of the display image part item data, touch area information about the touch areas defined for respective items is read into the touch area table 45*b*-1-8. Then, on the basis of the tree structure of the tree structured table, the display information (display flags and current numbers) of the item table, and the image data information, the display data expander 45*b*-1-5 reads real dot picture data from the dot picture image data portion of the panel data storage and expands/displays the dot picture data onto the liquid crystal panel. As a result, initial display is carried out as shown in FIG. 17A. Display is made so that respective display images and respective button images are put on a frame image in accordance with their display positions by EOR processing on the basis of the tree structure, as mentioned above. In this case, the display flag of the display image part item "left background" is set to be 0 (see FIG. 15**).

As the dot picture image of the item "start button", characters "start" and "pause" are drawn in a gray circle as shown in FIG. 17A. As the image for the current number 0 (OFF), a dot picture image with outline characters "start" and black characters "pause" is prepared. As the image for the current number 1 (ON), a dot picture image with black characters "start" and outline characters "pause" is prepared. Similarly, as dot picture images of the items "heavy button", "standard button" and "light button", dot picture images with white characters "heavy dirt", "standard" and "light dirt" in gray circles are prepared as images for the current number 0, respectively. In addition, dot picture images with black characters "heavy dirt", "standard" and "light dirt" in gray circles are prepared as images for the current number 1, respectively. Thus, characters showing contents are written in each operation button dot picture image, and the color of the characters is designed to change in accordance with the ON/OFF state. In addition, item (image display) areas shown by the dotted lines are specified as touch areas. When one of the touch areas is selected by the pressure of the user, the button images, specifically the color of the characters in the button images changes. For example, the character color of an operation button changes from outline to black. For example, when the "standard button" is selected, the characters "standard" in the gray circle of the "standard" button changes from outline to black.

Succeedingly, after carrying out various kinds of initialization, the first microcomputer 35 first reads out the setting and operation conditions of the last washing from the EEPROM 40. Then, the first microcomputer 35 sends the second microcomputer 45 a command to display the contents of the EEPROM 40. The second microcomputer 45 is in wait for command reception. After receiving the command from the first microcomputer 35, the second microcomputer 45 changes the display image part item data which was read into the display image part item table 45*b*-1-9 at the time of initialization. For example, if the last washing is standard one, the second microcomputer 45 receives a command {EEPROM standard-wash}. (This setting is usually made at the time of factory shipment.) The received command is interpreted by the step information interpreter 45*b*-1-3, and the current number of the display image part item "standard washing" is set to be 1. As a result, the display after the initialization is changed to a condition shown in FIG. 17B, so that the color of the characters of the standard button image turns black. Similarly, as for the other contents of the EEPROM, commands {EEPROM *} are sent to change the current numbers of the button or selector display image part items. Then, the current number of the display image part item "standard washing" is rewritten alternately between 0 and 1 at intervals of 1 second by use of the timer. As a result, the display is changed at intervals of 1 second between FIG. 17A and FIG. 17B. That is, the characters "standard" blinks to inform the user that this setting was selected by the user the last time.

Description will be made about the case where nothing is stored in the EEPROM 40. In the same manner as mentioned above, the second microcomputer 45 first reads a tree structure (of the first display/operation panel layout) designated by the display/operation panel layout selection switch 16. Display image parts are disposed on the liquid crystal display portion in accordance with the tree structure data. First the display image part item "full background" which is at the head is displayed, and next the display image part item "right background" which is a child of the item "full background" is displayed. Then, various kinds of button display image part items are displayed on the display image part item "right background". At the beginning, the display flag of the display image part item "right background" is 0. Therefore, the display image part item "right background" itself and the display image part items disposed thereon are not displayed. This display conditions are shown in FIG. 17A. In this case, the characters "standard" does not blink.

Figure 17B:
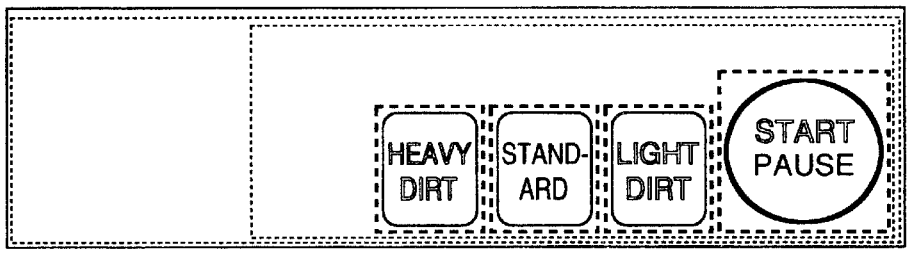

After that, the second microcomputer 45 reads the xy coordinates of a pointed area. This coordinate reading operation is carried out by periodical interrupt handling. The xy coordinate output circuit 3*a*-6 outputs the coordinates pointed by the user to the second microcomputer 45. With this output as a trigger, the second microcomputer 45 retrieves the touch area table 45*b*-1-8. Now, assume that the user touches the touch area of the "standard" button display image part item and indicates "standard" washing. The coordinate retriever 45*b*-1-6 retrieves the touch area table 45*b*-1-8 on the basis of the inputted xy coordinates, and becomes aware that the coordinates belong to the "standard" button display image part item. Thus, the coordinate retriever 45*b*-1-6 sends the item manager 45*b*-1-7 the ID of the "standard" button display image part item. The item manager 45*b*-1-7 reads out the "standard" button display image part item data from the display image part item table 45*b*-1-9 on the basis of the ID, and gives the action script interpreter 45*b*-1-1 an action script {standard-wash} included in the data. At the same time, the current number of the "standard" button display image part item data in the display image part item table 45*b*-1-9 is rewritten from 0 to 1. Thus, the image data information is changed so that the image "standard button" is changed from the OFF dot picture image data to the ON dot picture image data. Likewise, in the case where the image "standard button" is blinking, the current number is fixed to 1 no matter the current number has been ever changed, and the timer is stopped. Thus, the blinking action is stopped. In this case, as shown in FIG. 17B, the liquid crystal display of the characters "standard" in the gray circle of the "standard button" dot picture image changes from outline to black. In addition, the coordinate retriever 45*b*-1-6 gives the buzzer driver 45*b*-8 instructions to generate an electronic sound from the piezoelectric buzzer 49 and inform the user that the pressure has been accepted. The action script interpreter 45*b*-1-1 interprets the action script {standard-wash} as one of the washing steps and waits for the next button operation of the user.

Figure 17C:
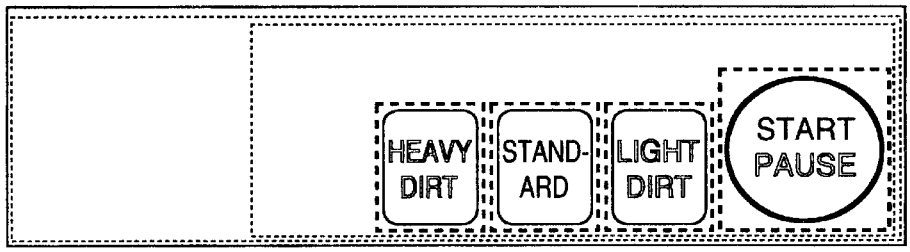

Now, description will be made on the assumption that the user points the touch area of the display image part item "start button" succeedingly. In the same manner as mentioned above, the coordinate retriever 45*b*-1-6 retrieves the touch area table 45*b*-1-8 on the basis of the inputted xy coordinates, and becomes aware that the coordinates belong to the display image part item "start button". Thus, the ID of the display image part item "start button" is sent to the item manager 45*b*-1-7. The item manager 45*b*-1-7 reads out the "start button" display image part item data from the display image part item table 45*b*-1-9 on the basis of the ID, and gives the action script interpreter 45*b*-1-1 an action script {start} included in the data. The action script interpreter 45*b*-1-1 interprets the action script {start} as start of washing operation, and supplies commands {standard-wash} and {start} to the first microcomputer 35 through the command transmitter 45*b*-1-4, the two-way communication portion 45*a* and the two-way communication circuit 46. At the same time, the current number of the "start button" display image part item data in the display image part item table 45*b*-1-9 is rewritten from 0 to 1. Thus, the start address of the dot picture image data is changed so that the "start button" image data is changed from the OFF dot picture image data to the ON dot picture image data. In this case, as shown in FIG. 17C, the liquid crystal display is changed to an image with the start button image changed in color of character pixels. In addition, the coordinate retriever 45*b*-1-6 gives the buzzer driver 45*b*-8 instructions to generate an electronic sound from the piezoelectric buzzer 49 and inform the user that the pressure has been accepted. In such a manner, the user is informed of acceptance by sound while the display is changed.

Figure 17D:
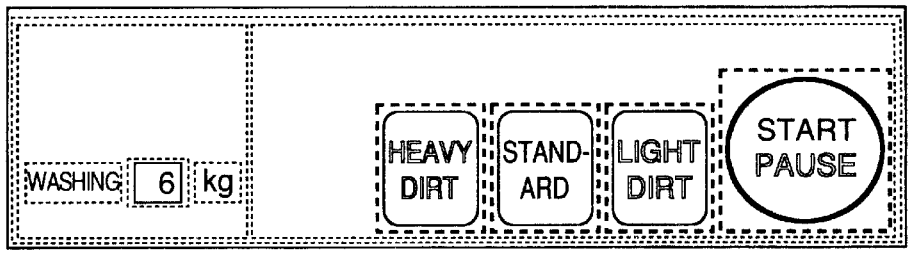

The first microcomputer 35 receives the commands {standard-wash} and {start} from the second microcomputer 45, and confirms that the user pressed the touch areas of the display image part items "standard button" and "start button". The first microcomputer 35 first drives the rotor blades to detect the amount of inputted washing. Then, the first microcomputer 35 sends the second microcomputer 45 the detection results, that is, washing amount information as a command {washing 6 kg}. The second microcomputer 45 receives the command through the command receiver 45*b*-1-2, interprets the command as a request of display of the washing amount in the step information interpreter 45*b*-1-3, and rewrites the display flag of the display image part item "left background" from OFF to ON. Then, after enabling the display of the display image parts "washing display", "figure display" and "unit display", the second microcomputer 45 interprets the current numbers of the respective display image part items in the step information interpreter 45*b*-1-3 and rewrites the current numbers on the basis of the command sent from the first microcomputer 35. FIG. 17D shows the display as a result. The characters "washing" are put in the "washing display", "6" is put in the "figure display", and "kg" is put in the "unit display".

Figure 17E:
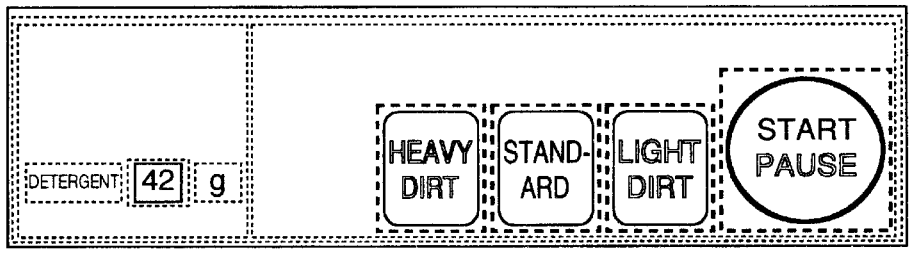
Figure 17F:
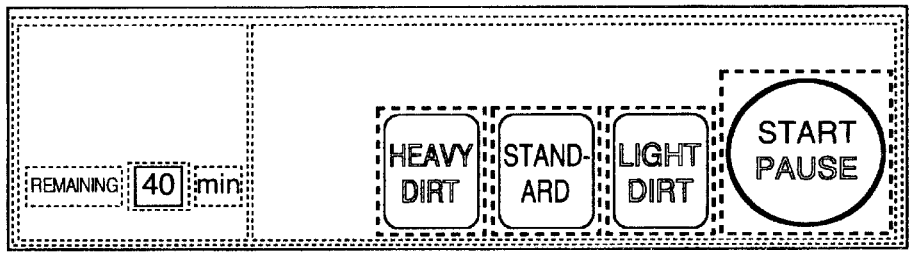

After a predetermined time, the first microcomputer 35 calculates a suitable amount of detergent on the basis of the amount of the washing so as to display the amount of detergent suitable for the amount of the washing. Then, the first microcomputer 35 sends a command {detergent 42 g} to the second microcomputer 45. In the second microcomputer 45, the step information interpreter 45*b*-1-3 interprets the command, and the item manager 45*b*-1-7 rewrites the current numbers of the respective display items. Thus, the display is made as shown in FIG. 17E. In this case, the current numbers are rewritten from 1 to 2.

The first microcomputer 35 opens the water supply electromagnetic valve 27 and starts to supply water to the washing tub 6. The user puts detergent into the washing tub before water supply starts. Tap water is reserved in the outer tub 4 (washing tub 6) from the tap water port 26 through the water supply electromagnetic valve 27.

When the first microcomputer 35 becomes aware, through the water level sensor 19, that a defined amount of wash water has been supplied into the outer tub 4, the first microcomputer 35 closes the water supply electromagnetic valve 27 so as to stop the water supply. Then, in order to rotate the rotor blades 7 forward/backward, the first microcomputer 35 controls the PWM inverter circuit 39 to drive the DC brushless motor 9*a*. As a result, the rotor blades 7 start rotating forward/backward. Thus, washing starts.

When washing starts, the first microcomputer 35 sends the second microcomputer 45 a command {remaining 40 min} to display the time to finish the washing on the display/operation panel. When the second microcomputer 45 receives the command in the command receiver 45*b*-1-2, the second microcomputer 45 interprets the command as a request of display of the remaining time in the step information interpreter 45*b*-1-3. The second microcomputer 45 makes the item manager 45*b*-1-7 change the current number of the display image part item "step display" from 2 to 3, so that the display character image is changed from "detergent amount" to "remaining". Further, the second microcomputer 45 makes the item manager 45*b*-1-7 change the current number of the display image part item "figure display" from 2 to 3, so that the display character image is changed from "6" to "40". In addition, the second microcomputer 45 makes the item manager 45*b*-1-7 change the current number of the display image part item "unit display" from 2 to 3, so that the display character image is changed from "kg" to "min". As a result, the display is changed into the image shown in FIG. 17F. Such remaining time display is performed periodically, for example, at intervals of 1 minute by use of the timer function. Not to say, since the remaining time is reduced with the progress of the washing, the current number of the display image part item "figure display" is rewritten to reduce the displayed figure.

After the first washing step is terminated, the first microcomputer 35 opens the drain valve 13 so as to drain the wash water from the outer tub 4. After the draining is terminated, the washing machine moves to a first dehydrating step. At this time, through the cover open/close sensor 20, the first microcomputer 35 becomes aware whether the cover is opened or not. If the cover is opened, the first microcomputer 35 stops the progress of the washing steps temporarily, and sends the second microcomputer 45 a command {error C3} through the two-way communication circuit 41 for the sake of safe operation. In the second microcomputer 45 receiving the command, the step information interpreter 45*b*-1-3 interprets the command as a request of display of an error caused by the opening of the cover. Then, the second microcomputer 45 makes the item manager 45*b*-1-7 rewrite the current number of the display image part item "step display" from 3 to 4, so that the display character image is changed from "remaining" to "dehydrate". Further, the second microcomputer 45 makes the item manager 45*b*-1-7 change the current number of the display image part item "figure display" from 3 to 4, so that the display character image is changed from "40" to "C3". In addition, the second microcomputer 45 makes the item manager 45*b*-1-7 change the current number of the display image part item "unit display" from 3 to 0, so that the display character image is changed from "min" to " " (transparent image without any character). At this time, the display image part items "step display" and "figure display" are displayed blinking. This blinking is carried out by rewriting the current numbers of the respective display image part items between from 4 to 0 (transparent image without any character) and from 0 to 4 at intervals of a fixed time, for example, at intervals of 1 second by the timer function. Further, the second microcomputer 45 gives instructions to the buzzer driver 49*a* at such intervals so as to generate an electronic sound from the piezoelectric buzzer 49 and generate a warning sound. In addition, the current number of the display image part item "start button" is changed from 1 (ON) to 0 (OFF) so that the characters of the button images are stopped temporarily. If the user closes the cover and presses the touch area of the display image part item "start button", the second microcomputer 45 makes the item manager 45*b*-1-7 change the current number of the display image part item "start button" from 0 to 1 and change the color of the characters while transmitting a command {start} to the first microcomputer 35. The first microcomputer 35 receives the command and confirms that the cover has been closed. Then, the first microcomputer 35 resumes the pausing steps.

On the contrary, there are some cases where the user stops the washing steps temporarily. For example, in the middle of the step of washing or rinsing, the user may add other washing forgotten to input. In such a case, the user presses the touch area of the display image part item "start button". In the same manner as mentioned above, the coordinate retriever 45*b*-1-6 retrieves the touch area table 45*b*-1-8 on the basis of the inputted xy coordinates, and finds that the coordinates belong to the display image part item "start button". Then, the ID of the display image part item "start button" is sent to the item manager 45*b*-1-7. The item manager 45*b*-1-7 reads out the display image part item data from the item table 45*b*-1-9 on the basis of the ID, and gives the action script interpreter 45*b*-1-1 an action script {pause} included in the item data. The action script interpreter 45*b*-1-1 interprets the action script {pause} as pause of washing operation, and supplies a command {pause} to the first microcomputer 35 through the two-way communication circuit 46. At the same time, the current number of the display image part item "start button" in the part item table 45*b*-1-9 is rewritten from 0 to 1. Thus, the dot picture image start address is changed so that the "start button" dot picture image is changed from ON to OFF. In this case, the liquid crystal display is changed to an image with the start button image changed in color of character pixels. In addition, the coordinate retriever 45*b*-1-6 gives the buzzer driver 49*a* instructions to generate an electronic sound from the piezoelectric buzzer 49 and inform the user that the pressure has been accepted. The first microcomputer 35 receiving the command {pause} stops the step which is in progress. For example, the first microcomputer 35 stops the rotation of the motor. Then, the first microcomputer 35 waits for the user to issue an instruction to resume the step. If the user presses the touch area of the image part item "start button" again, then the second microcomputer 45 transmits a command {start} to the first microcomputer 35. In response to the command, the first microcomputer 35 resumes the washing step.

The first microcomputer 35 detects the whirling of the outer tub 4 through the tub whirling sensor 22 when dehydration starts in the washing steps. If clothes get entangled due to washing/stirring so that clothes lean to one side without sinking uniformly in the washing tub bottom portion when water drainage has been finished, there is a risk that the outer tub 4 whirls large to collide with the outer frame 1, and the washing machine may fall down as the worst case. To prevent such a risk, the whirling of the outer tub 4 is detected by the tub whirling sensor 22, and a warning is issued to the user if the whirling is large. The first microcomputer 35 monitors the tub whirling sensor 22 when dehydration starts. If there is a sensor output, the first microcomputer 35 concludes a clothes lean error and stops power supply to the motor 9*a* immediately. In addition, the first microcomputer 35 confirms that the washing tub has stopped its rotation, and releases the cover lock mechanism 21. Then, the first microcomputer 35 sends a command {error C4} to the second microcomputer 45 through the two-way communication circuit 41. When the second microcomputer 45 accepts the command in the command receiver 45*b*-1-2, the step information interpreter 45*b*-1-3 interprets the command as a request of display of an error in dehydration start. Then, the second microcomputer 45 makes the item manager 45*b*-1-7 rewrite the current number of the display image part item "step display" so that the display character image is changed from "remaining" to "dehydrate". In addition, the second microcomputer 45 makes the item manager 45*b*-1-7 change the current number of the display image part item "figure display" so that the display character image is changed from "33" to "C4". Further, the second microcomputer 45 makes the item manager 45*b*-1-7 change the current number of the display image part item "unit display" so that the display character image is changed from "min" to " " (transparent image without any character). At this time, the display image part items "step display" and "figure display" are displayed blinking by the timer function. This blinking is carried out by rewriting the current numbers of the respective display image part items between from 5 and 0 (transparent image without any character) and from 0 to 5 at intervals of a fixed time, for example, at intervals of 1 second. Further, the second microcomputer 45 gives instructions to the buzzer driver 49*a* at such intervals so as to generate an electronic sound from the piezoelectric buzzer 49 and generate a warning sound.

As has been described above, according to this embodiment, various kinds of information detected during the washing steps and necessary for the user can be displayed on a predetermined area dynamically only at the time of necessity. Thus, the display layout of the display/operation panel can be made elegant. In the background art, display is made always appear since it is printed. Thus, the panel is filled with complicated characters and symbols, and it is impossible to display such characters and symbols in accordance with necessity as described in this embodiment.

When the washing steps are terminated, the first microcomputer 35 sends a command {finish} to the second microcomputer 45 so as to inform the user of the termination of the washing steps. When the second microcomputer 45 accepts the command in the command receiver 45*b*-1-2, the step information interpreter 45*b*-1-3 interprets the command as a request of display of step termination. Then, the second microcomputer 45 makes the item manager 45*b*-1-7 reset the display flag of the display image part item "left background" (to thereby return the screen to the initial one which was displayed when power was turned on).

Figure 18:
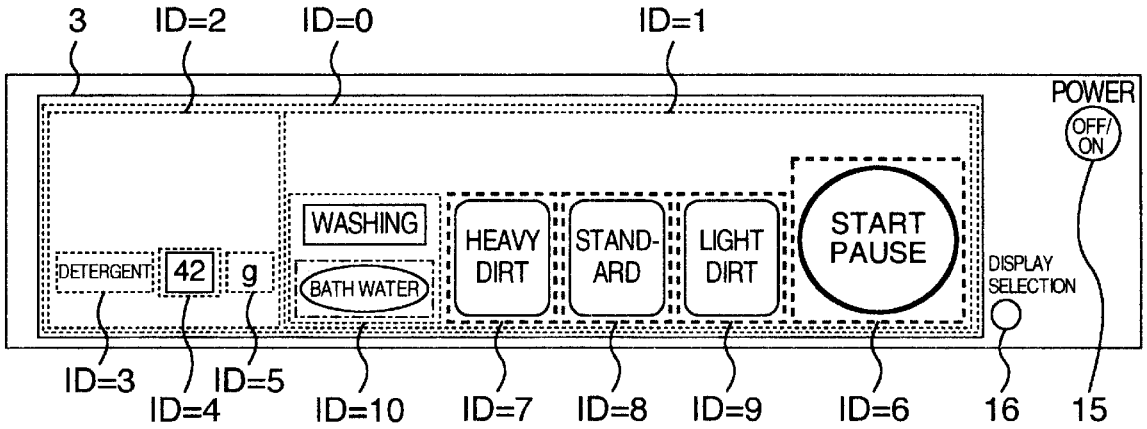
FIG. 18 is a view showing a second display/operation panel layout.
Figure 19:
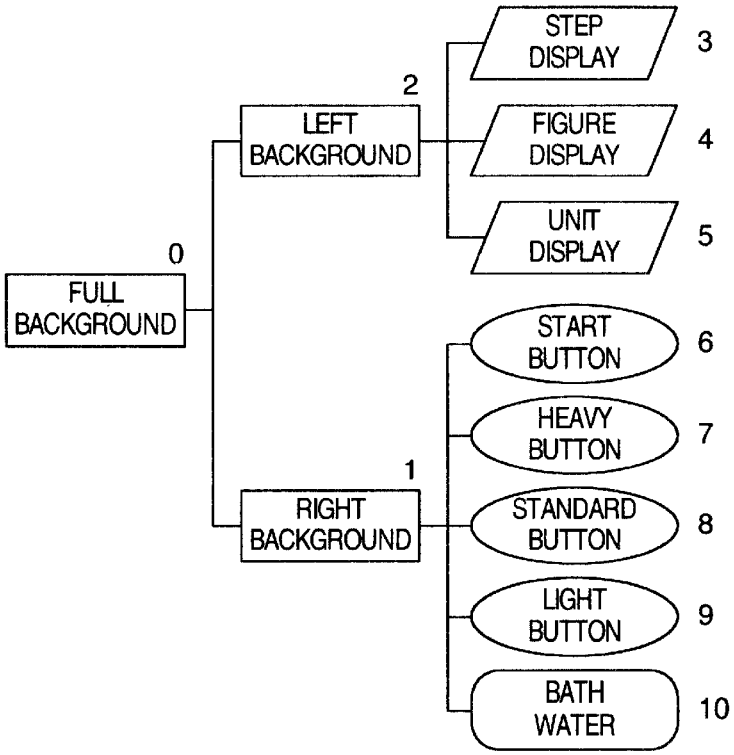
FIG. 19 is a tree structured diagram showing the second display/operation panel layout.

FIG. 18 shows another example of the display/operation panel layout (a second display/operation panel layout). FIG. 18 shows the case where the second display/operation panel layout is selected by the selection switch 16. In this panel layout, a bathwater feeding function is added to the above-mentioned first panel layout. FIG. 19 shows a tree structure of the second panel layout. An image part item "bathwater" (item enclosed by the dotted line with ID=10 in FIG. 18) is added as a selector item in the display image part item "right background". The item "bathwater" has four image data shown in FIGS. 20A to 20D, and the areas enclosed by the one-dot chain lines are defined as touch areas.

In the same manner as in the display operation in the first display/operation panel layout, first, a tree structure of the second display/operation panel layout selected by the selection switch 16 is read into the tree structured table 45*b*-1-10 in the item manager 45*b*-1-7. Succeedingly, the item manager 45*b*-1-7 retrieves respective item data on the basis of the IDs of the tree structure, and reads a plurality of necessary display image part item data into the display image part item table 45*b*-1-9. At the same time, of the display image part item data, touch area information about the touch areas defined for respective items is read into the touch area table 45*b*-1-8. Then, on the basis of the tree structure of the tree structured table 45*b*-1-10 and the image data information of the item table 45*b*-1-9, the display data expander 45*b*-1-5 reads real dot picture image data from the dot picture image data portion of the panel data storage 45*b*-4 and expands/displays the dot picture image data onto the liquid crystal panel.

Figure 20A:
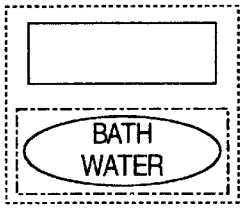
FIGS. 20A to 20D are views showing image data of an item "bathwater"
Figure 20B:
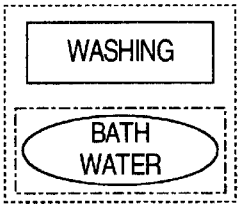

Bathwater feeding will be described. After power is turned on, the current number of the display image part item "bathwater" is set to be 0. Accordingly, the dot picture image of the item "bathwater" is displayed as shown in FIG. 20A. The other display image part items are similar to those in the description of the first panel layout (FIGS. 17A to 17F). When the touch area of the selector display image part item "bathwater" is pressed by the user, the xy coordinate output circuit 3*a*-6 outputs the coordinates pointed by the user to the second microcomputer 45. With this output as a trigger, the second microcomputer 45 retrieves the touch area table 45*b*-1-8. As a result, the ID of the selector display image part item "bathwater" is sent to the item manager 45*b*-1-7. The item manager 45*b*-1-7 reads out the item data from the data storage on the basis of the ID, and gives the action script interpreter 45*b*-1-1 an action script {bathwater wash} included in the item data. The current number is updated to 1 so as to form a washing display image in FIG. 20B. This is the setting to use residual bathwater only for washing.

Figure 20C:
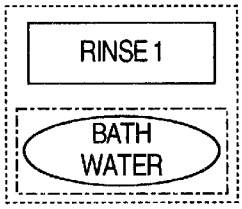
Figure 20D:
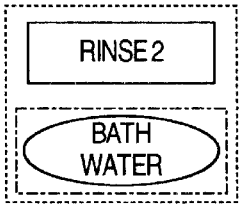

The display image part item "bathwater" is a selector item having four display pointers. The display pointers are "unused", "wash", "rinse-1" and "rinse-2" respectively, and {bathwater no}, {bathwater wash}, {bathwater rinse-1} and {bathwater rinse-2} are described as script respectively. In the above-mentioned case, the action script interpreter 45*b*-1-1 interprets "bathwater" as use of the bathwater feed pump, and supplies a command {bathwater wash} to the first microcomputer 35 through the two-way communication circuit 46. If the touch area is pressed again, the current number is increased by one, and a command {bathwater rinse-1} is transmitted. At the same time, the image is changed as shown in FIG. 20C. If the touch area is further pressed, the current number is increased by one, and a command {bathwater rinse-2} is transmitted. At the same time, the image is changed as shown in FIG. 20D. If the touch area is further pressed, the current number returns to 0, and a command {bathwater no} is transmitted. At the same time, the image is changed as shown in FIG. 20A. In such a manner, the selector item carries out display operation cyclically. On the basis of the command shown when the touch area of the display image part item "start button" is pressed, the first microcomputer 35 controls the bathwater feed pump 28 to supply water to the washing tub 6.

The operation in bathwater supply will be described. Water from a bath tub is pumped out through a hose connected to a bathwater feed port 28*a*. When the first microcomputer 35 receives a command {bathwater wash} from the second microcomputer 45, the first microcomputer 35 opens the water supply electromagnetic valve 27 for a short time (about 15 seconds). Thus, tap water is supplied to the washing tub 6 through the water supply electromagnetic valve 27. At this time, a part of supplied water flows into the bathwater feed pump 28 through a priming water inlet. This is a priming water to the bathwater feed pump 28. After that, the pump motor is rotated so that bathwater is self-sucked through the bathwater feed port 28*a* to be thereby fed to the washing tub 6. When bathwater is self-sucked and supplied in such a manner, the first microcomputer 35 detects an electric current value flowing in the pump motor though a current sensor 28*d* and the amount of bathwater reserved in the washing tub 6 through the water level sensor 19. When bathwater is self-sucked (when the air in the hose is discharged), the load is so light that the current value is small. When bathwater feeding is started, the load is so heavy that the current value increases. If the current value does not increase even though the self-suction time exceeds a predetermined time (for example, two minutes), the first microcomputer 35 concludes that the water feed hose is not attached or there is no residual bathwater in the bath tub so that bathwater cannot be supplied. Then, the first microcomputer 35 sends a command {error C1} to the second microcomputer 45 so as to warn the user. Since the operation after that is the same as the above description, detailed description thereof is omitted. Thus, warning contents are displayed in the display area of the display/operation panel while an electronic sound rings.

When water feeding is started after self-suction is terminated, bathwater is reserved gradually in the washing tub 6. At this time, if the water level value of the water level sensor 19 does not reach a predetermined water level, the increase change in the water level stops, and a predetermined time (for example, two minutes) has passed with the electric current value remained small, the first microcomputer 35 concludes that there is no bathwater in the bath tub, and sends a command {error C2} in the same manner as mentioned above. Then, a blinking error display and an electronic sound as mentioned above draw the user's attention.

According to the present invention, new functions and control or the like accompanied with the new functions can be added onto the display/operation panel 3 easily, and the user can issue instructions by pressing the display/operation panel 3 to use the new functions. In addition, error display, information, and so on, about the new added functions can be added easily.

Figure 21:
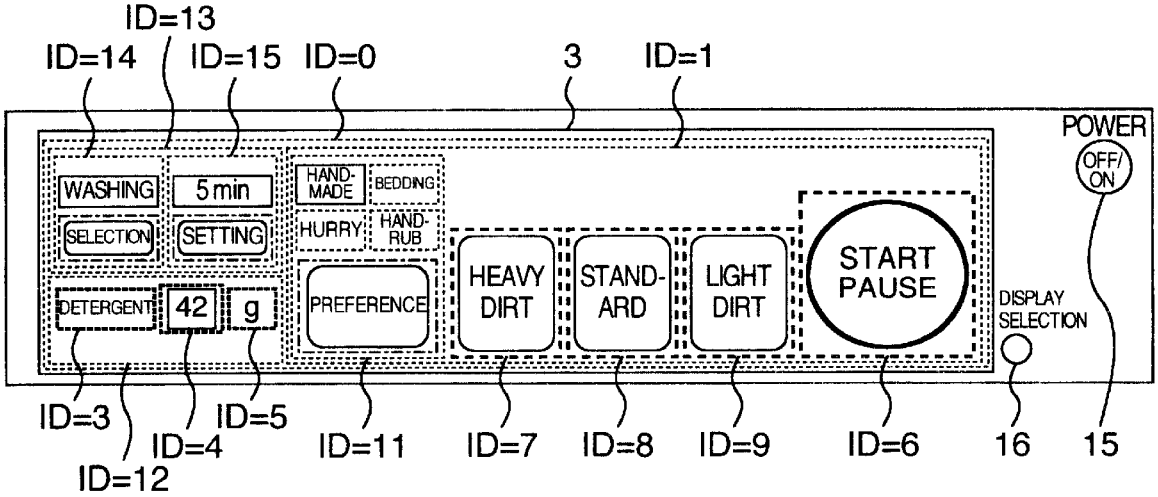
FIG. 21 is a view showing a third display/operation panel layout.
Figure 22:
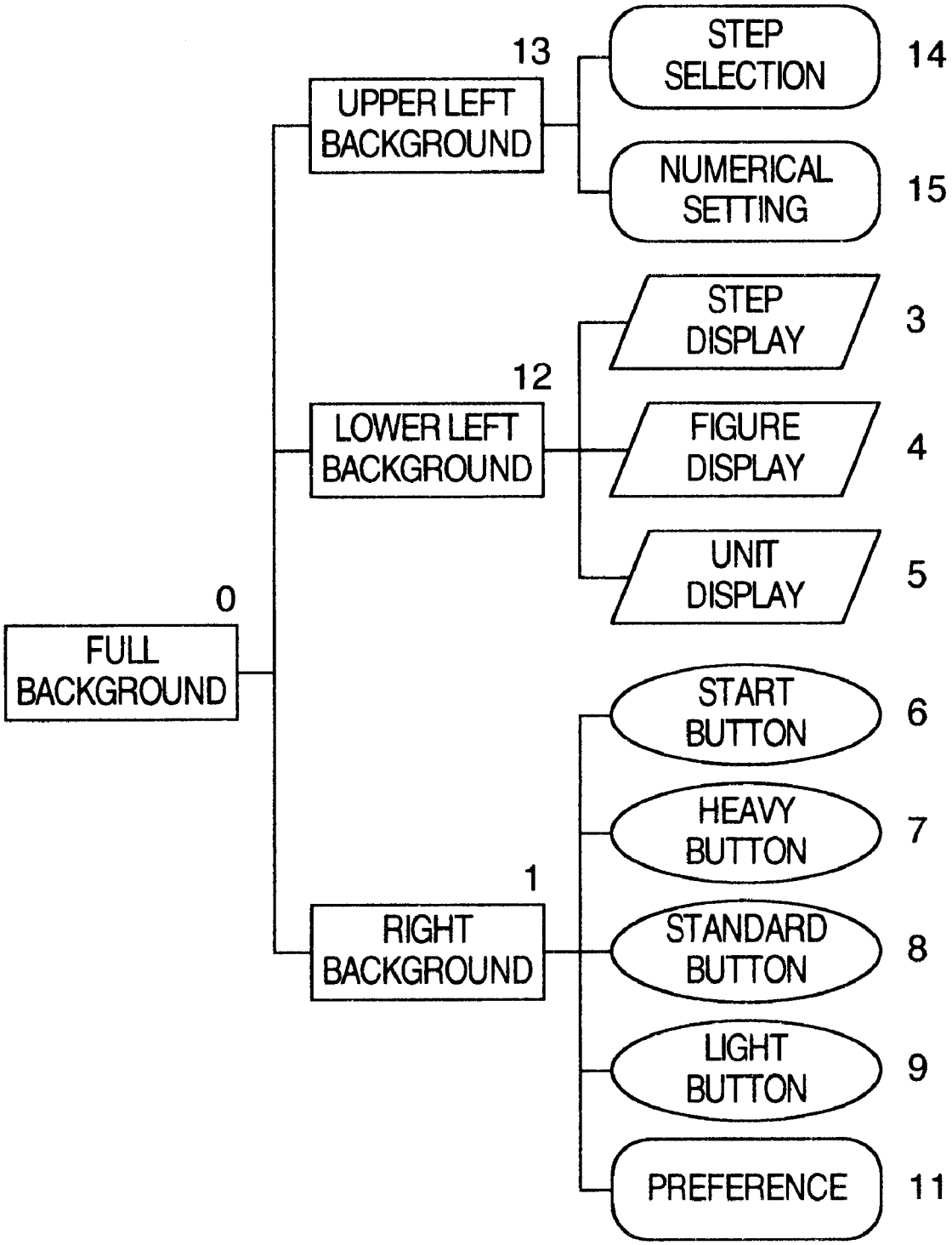
FIG. 22 is a tree structured diagram showing the third display/operation panel layout.
Figure 23A:
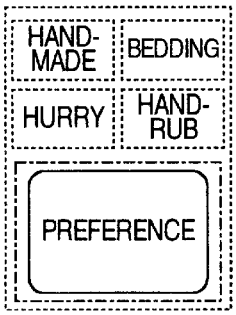
FIGS. 23A to 23E are views showing image data of an item "preference"
Figure 23B:
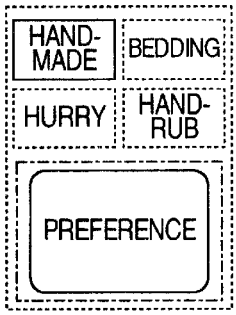
Figure 23C:
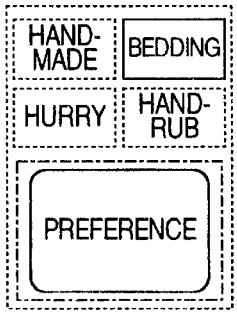
Figure 23D:
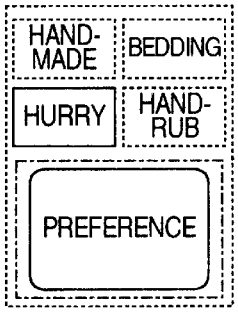
Figure 23E:
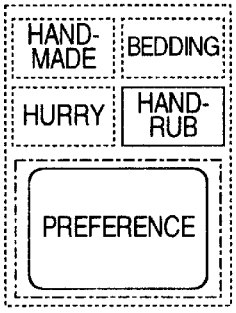

FIG. 21 shows a third example of the display/operation panel layout. FIG. 21 shows the case where the third display/operation panel layout is selected by the selection switch 16. In this panel layout, washing steps are further added to the above-mentioned first panel layout, and a selector display image part item "preference" for selecting one of the washing steps is added. The selector display image part item "preference" is added so that one of washing steps "handmade", "bedding", "hurry" and "hard-rub" can be selected. The washing step "handmade" is to allow the user to set the washing time, the number of times of rinsing and the dehydrating time freely. The washing step "bedding" is to wash bedding. The washing step "hurry" is to wash in a short time. The washing step "hard-rub" is to wash a small amount of muddy washing. FIG. 22 shows a tree structure of this third panel layout. The display image part item "preference" (enclosed by the dotted line with ID=11) shown in FIG. 21 is added as a selector item in the display image part item "right background". The item "preference" is designed to have five dot picture image data shown in FIGS. 23A to 23E, and the areas enclosed by the one-dot chain lines are defined as touch areas. The display image part item "left background" is divided into display image part items "upper left background" and "lower left background". Display image part items "step selection" and "numerical setting" are disposed in the display image part item "upper left background". Display image part items "step display", "figure display" and "unit display" are disposed in the display image part item "lower left background" in the same manner as in the first panel layout. Only when the item "handmade" in the display image part item "preference" is selected, the display image part item "upper left background" is made visible so that the display image part items "step selection" and "numerical setting" are displayed. This is realized by describing a command {upper-left-background set} in the action script for the image shown in FIG. 23B, succeedingly describing a command {handmade-wash} showing the contents of the selector item, and adding description of a command {upper-left-background clear} as well as commands {bedding-wash}, {hurry-wash} and {hard-rub-wash} showing the contents (washing steps) of the selector items in the action scripts for the other images, respectively. If commands for controlling the display of other image parts are added to action scripts in such a manner, many complicated image layouts can be obtained.

In the same manner as in the display operation in the first display/operation panel layout, first, a tree structure of the third display/operation panel layout selected by the selection switch 16 is read into the tree structured table 45*b*-1-10 in the item manager 45*b*-1-7. Succeedingly, the item manager 45*b*-1-7 retrieves respective item data in the display image part item data portion of the panel data storage 45*b*-4 on the basis of the IDs of the tree structure, and reads a plurality of necessary display image part item data into the display image part item table 45*b*-1-9. Touch area information of the respective items are read into the touch area table 45*b*-1-8. Then, on the basis of the image data information of the item table 45*b*-1-9, the display data expander 45*b*-1-5 expands/displays dot picture image data of the panel data storage 45*b*-4 onto the liquid crystal panel 3.

When the user presses the touch area (enclosed by the one-dot chain line) of the display image part item "step selection", the character display image changes into "wash" (current number 1), "rinse" (current number 2) and "dehydrate" (current number 3) sequentially. The "numerical setting" display on the right also changes correspondingly to the respective display images. This change is achieved by describing the setting of the current number of the display image part item "numerical setting" in the action scripts for the respective images. Now, as for the dot picture images of the display image part item "numerical setting", assume that there are twelve display dot picture images in total, that is, five display images for showing the washing time: "3 min" (current number 1), "5 min" (current number 2), "8 min" (current number 3), "12 min" (current number 4) and "15 min" (current number 5); two display dot picture images for showing the number of times of rinsing: "once" (current number 6) and "twice" (current number 7); and five display dot picture images for showing the dehydrating time: "1 min" (current number 8), "3 min" (current number 9), "5 min" (current number 10), "8 min" (current number 11) and "12 min" (current number 12). For example, {wash} {ID=15 (display image part item "numerical setting") set-current-number-1} are described in the action script for the current number 1 (the character display "wash") of the display image part item "step selection", and {15 min} {ID=15 set-current-number-1} are described for the current number 5 (the character display "15 min") of the display image part item "numerical setting" initially.

When the characters "wash" is displayed in the display image part item "step selection", the display image part item "numerical setting" displays the characters "3 min" initially, and changes into the characters "5 min" (current number 2), "8 min" (current number 3), "12 min" (current number 4) and "15 min" (current number 5) and returns to the characters "3 min" again whenever the user presses the touch area of the item. Likewise, {rise} {ID=15 (item "numerical setting") set-current-number-6} are described in the action script for the current number 2 (the character display "rinse") of the display image part item "step selection", and {twice} {ID=15 set-current-number-6} are described for the current number 7 (the character display "twice") of the display image part item "numerical setting" initially. In addition, {dehydrate} {ID=15 (display image part item "numerical setting") set-current-number-8} are described in the action script for the current number 3 (the character display "dehydrate") of the display image part item "step selection", and {12 min} {ID=15 set-current-number-8} are described for the current number 12 (the character display "12 min") of the display image part item "numerical setting" initially. Thus, the display of the display image part item "step selection" can be associated with the display of the display image part item "numerical setting", and the items "step selection" and "numerical selection" can be made cyclically.

Action scripts described for these images are sent to the action script interpreter 45*b*-1-1 sequentially so as to be used for image display control, while the action scripts are set to the first microcomputer 35 as commands. For example, a command {handmade-wash}, and succeedingly commands {wash 3 min}, {rinse once} and {hydrate 5 min} are transmitted to the first microcomputer 35.

As has been described above, the third example shows the case where the display and the operation method change dynamically (in accordance with the operation of pressure by the user) by use of the selector items. Display images are formed as parts and touch areas are defined in image parts to be operated by use of the touch panel 3*a* and the liquid crystal panel 3*b*. In addition, display operation scripts and action scripts as results of operation are set in parts having the touch areas respectively. Thus, a desirable display/operation panel can be made up.

Figure 24:
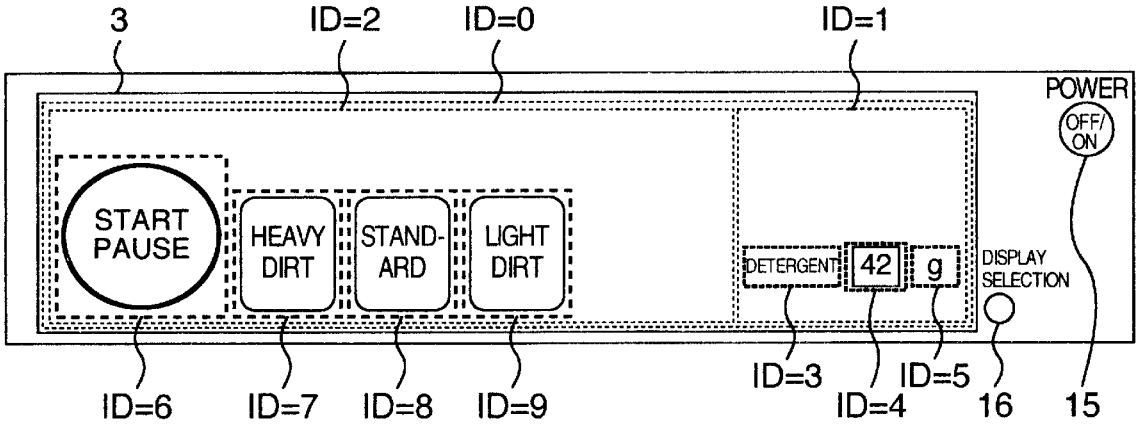
FIG. 24 is a view showing a fourth display/operation panel layout.

FIG. 24 shows an example of a fourth display/operation panel layout. FIG. 24 shows the case where the fourth display/operation panel layout is selected by the selection switch 16. In this panel layout, all the display arrangement in the first example (FIG. 15) are reversed left and right for a left-handed user. This layout can be realized only by changing the start coordinates for image data display in item data and the start coordinates for the touch areas without any change in the tree structure and the real dot picture image data in the first example. Therefore, a right/left-hand setting switch (not shown) other than the selection switch 16 may be provided. With the setting of the right/left-hand setting switch, only if the start coordinate data can be changed by a simple coordinate converting program so as to perform the expansion/display of image data and the pressure detection on the touch areas. Accordingly, the panel layout of FIG. 24 can be obtained.

As has been described above, according to this embodiment, if a plurality of layouts such as the first to third examples are stored and incorporated as tree structures, the user can change the operation method and the display desirably simply by operating the selection switch 16. It is not necessary to add real display image data, and the operation method is not involuntary one with initial print. Accordingly, it is possible to provide a washing machine which meets needs of users who want to change the operation method because of the users' preferences or inconvenience due to aging. Specifically, the first group of persons who want to wash without labor may select the first operation/display layout through the selection switch 16. The group of persons who want to wash carefully and variously contrivably in their own way may select the third operation/display layout. Left-handed persons may select the fourth operation/display layout.

Figure 25:
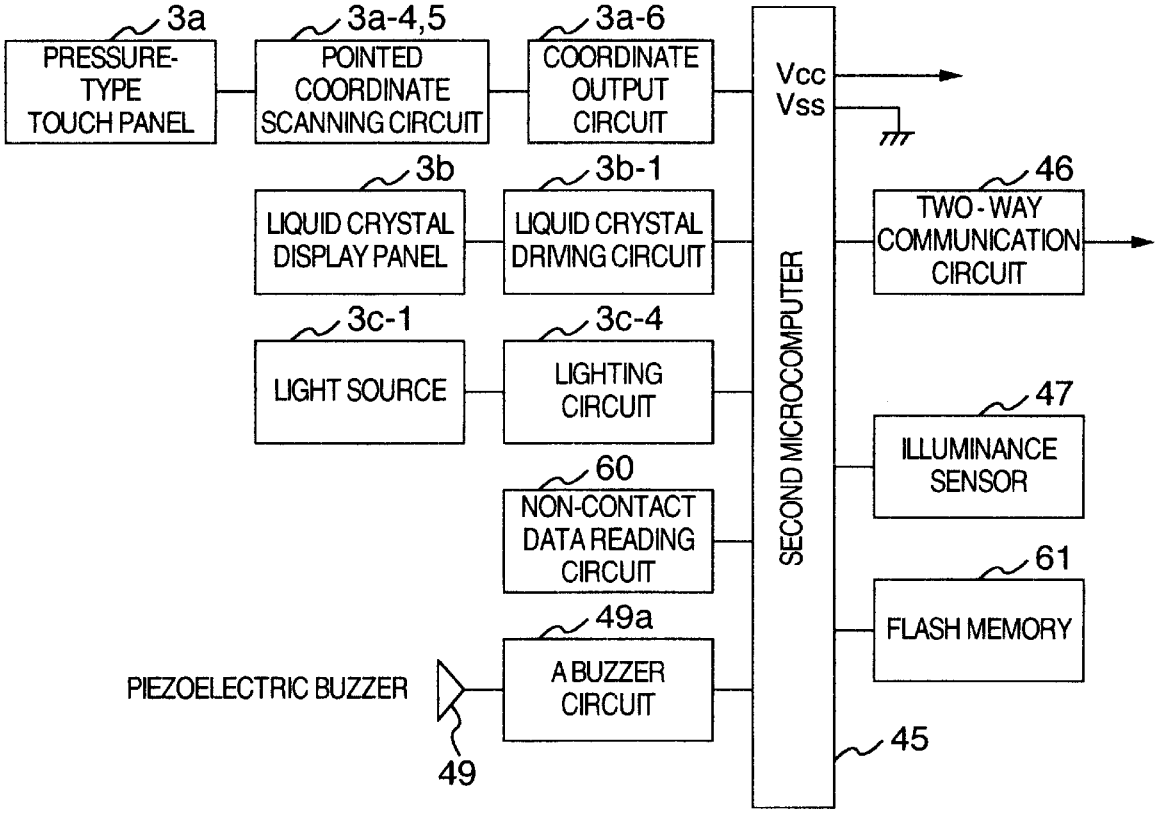
FIG. 25 is a diagram showing a display/operation controller according to a second embodiment of the present invention.

FIG. 25 shows a display/operation controller according to a second embodiment of the present invention. According to the configuration of the first embodiment, the user uses the display/operation selection switch 16 to select a plurality of display/operation panel layout data (expressed by tree structures) prepared in advance. In this second embodiment, the display/operation panel layout data can be written from the outside of the washing machine by use of a writer. In this manner, it is not necessary to store a plurality of data in the washing machine in advance, so that it is possible to reduce the ROM capacity of the second microcomputer 45. Thus, the washing machine can be therefore made inexpensive. In addition, the range of selection can be widened. Further, the display/operation panel layout data may be exchanged with other one later, and even if the user becomes inconvenient at operation due to aging, the convenience of the user can be improved by replacing the display/operation panel layout data with new data. In addition, when new detergent is put on the market, it is possible to introduce new washing steps which match the new detergent.

Figure 26:
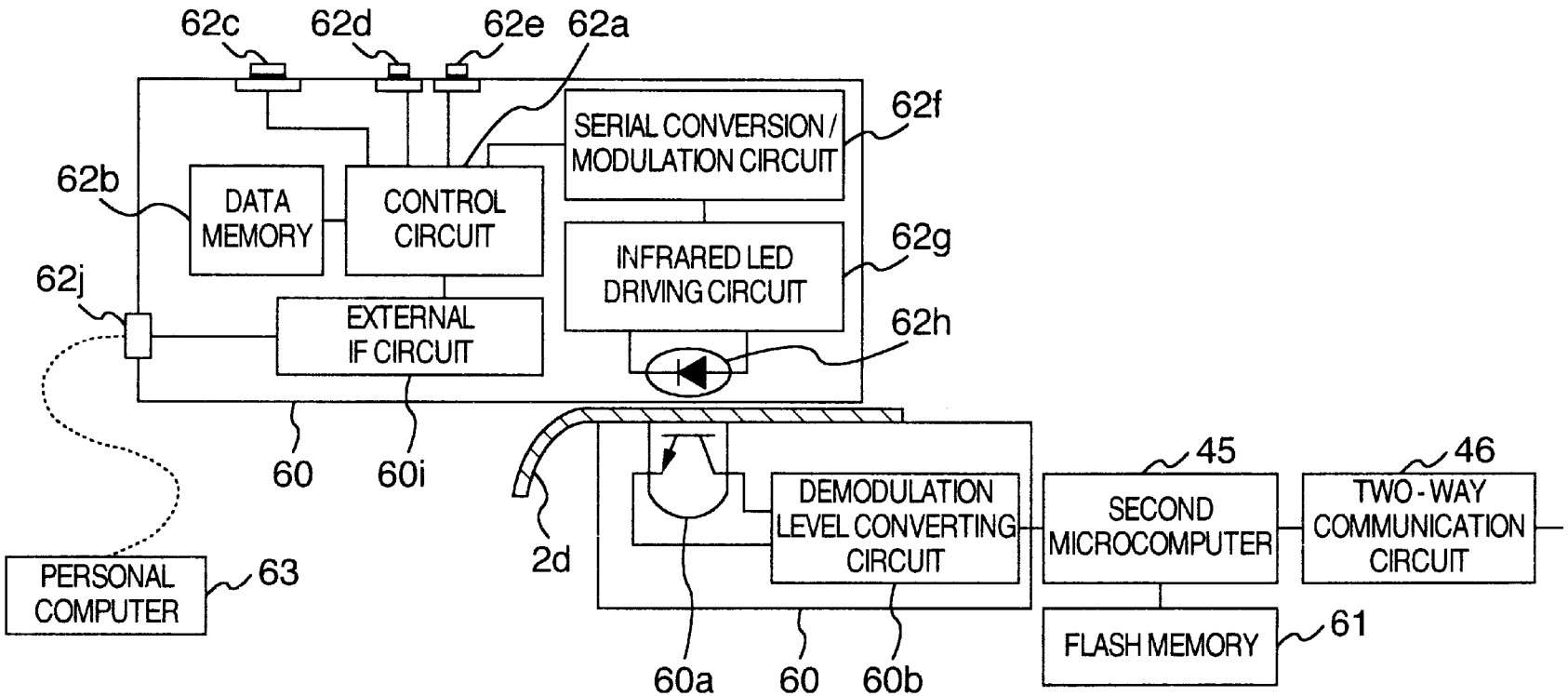
FIG. 26 is a detailed diagram showing a first embodiment of a display/operation panel layout data writer.

In FIG. 25, parts the same as those in FIG. 9 in the first embodiment are referenced correspondingly. A non-contact reading circuit 60 reads display/operation panel layout data from the outside of the washing machine without the aid of any connection terminal, and a flash memory 61 stores the read display/operation panel layout data. The other configuration is similar to that in the first embodiment (FIG. 9), and the description thereof will be therefore omitted. FIG. 26 shows the details of the non-contact reading circuit 60 and a display/operation panel layout data writer 62 for writing display/operation panel layout data into the non-contact reading circuit 60. Incidentally, a washing step controller (FIG. 7) connected to a display/operation controller shown in FIG. 25 is the same as that in the first embodiment, except parts of an EEPROM data (flash memory write flag which will be described later) and a send command (data reception command).

Figure 27:
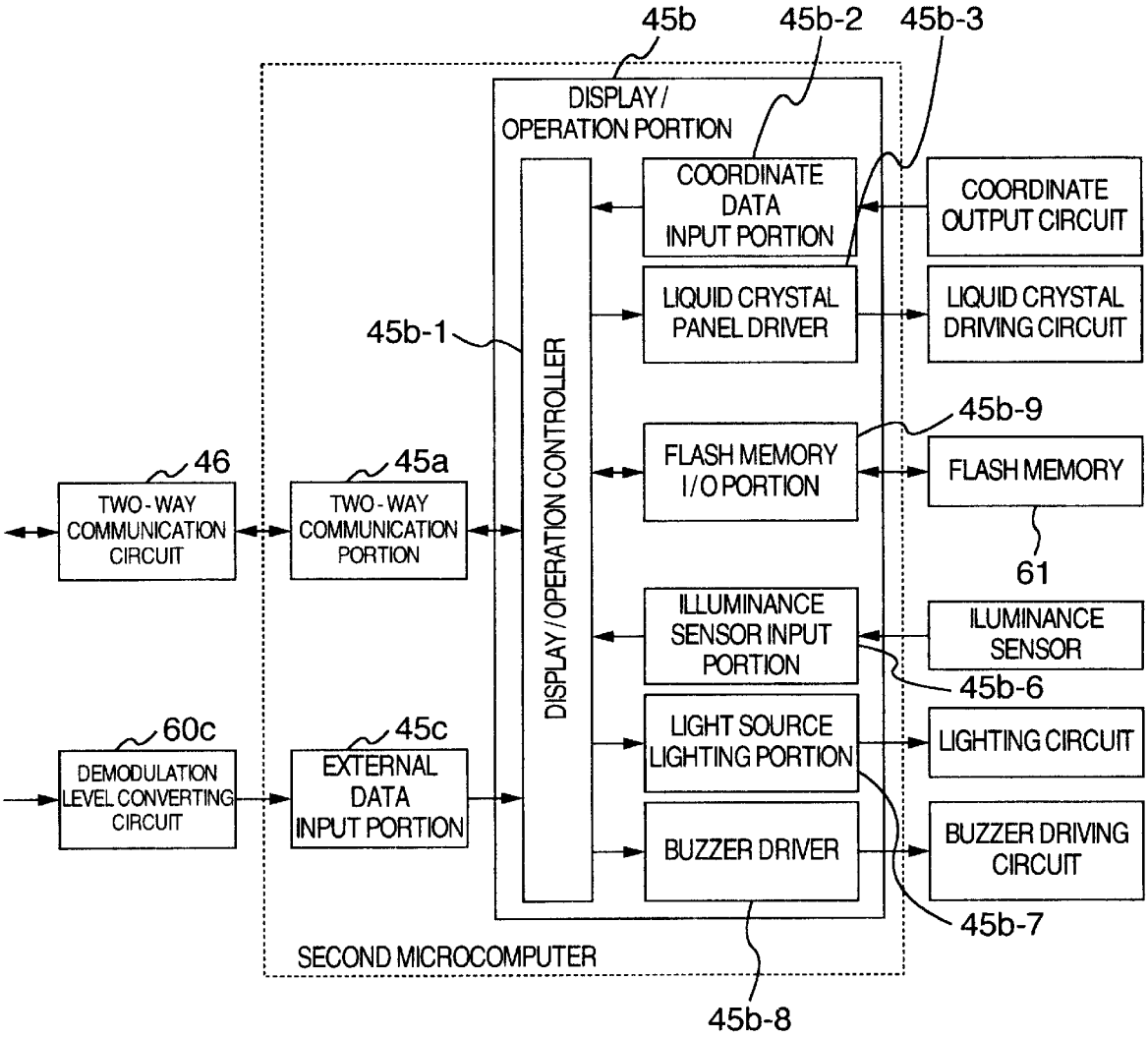
FIG. 27 a block diagram showing the software of a second microcomputer in the second embodiment of the present invention.

FIG. 27 shows the software configuration of a second microcomputer 45. In this second microcomputer 45, the selection switch input portion is omitted from the software configuration (FIGS. 10 and 12) of the second microcomputer 45 in the first embodiment. In addition, a flash memory input/output portion 45*b*-9 and an external flash memory 61 are added in place of the panel data storage 45*b*-4. Further, an external data input portion 45*c* for reading external data from a data demodulation level converting circuit 60*b* is added. The other configuration is similar to that in FIGS. 10 and 12.

In FIG. 26, by use of the display/operation panel layout data writer 62, display/operation panel layout data is written in the flash memory 61 through the non-contact data reading circuit 60 in this second embodiment of the present invention. The display/operation panel layout data writer 62 is constituted by a control circuit 62*a* including a microcomputer and so on, a data memory 62*b* for storing a plurality of display/operation panel layout data temporarily, a display/operation panel layout data selection switch 62*c* for selecting one of the plurality of display/operation panel layout data in the data memory 62*b*, a transmission start button 62*d* for starting to transmit the selected display/operation panel layout data, a rewrite request button 62*e* for making a request of rewriting display/operation panel layout data, a serial conversion/modulation circuit 62*f* for converting the display/operation panel layout data into serial data, carrier-modulating the serial data and outputting the modulated serial data, an infrared LED driving circuit 62*g*, an infrared LED 62*h*, an external interface circuit 62*i*, and an external connection terminal 62*j* such as an RS232C connector or the like. The reference numeral 63 represents a data processing unit such as a personal computer or the like. The infrared LED 62*h* outputs infrared light to the outside through an infrared optical filter (not shown) under the display/operation panel layout data writer 62.

A plurality of display/operation panel layout data constituted by tree structures, item data and image data as described in the first embodiment are made up by the data processing unit 63. For example, layout data of FIGS. 13, 18, 21 and 24, or the like, may be made up. The RS232C terminal of the processing unit 63 and the external connection terminal 62*j* of the display/operation panel layout data writer 62 are connected through an RS232C cable. Then, the display/operation panel layout data made up thus are stored in advance in the data memory 62*b* through the external interface circuit 62*i*. The method for writing the display/operation panel layout data from the processing unit 63 into the data memory 62*b* of the display/operation panel layout data writer 62 is similar to that in data communication usually carried out in personal computers or the like. Therefore, the description of the method is omitted.

A serviceman of a shop or the like carries the display/operation panel layout data writer 62 to a site where a washing machine has been installed. In the display/operation panel layout data writer 62, a plurality of display/operation panel layout data have been stored in the data memory 62*b* in advance. The serviceman writes one of the display/operation panel layout data into the washing machine. In the washing machine, an infrared light reception diode 60*a* is disposed, as the non-contact reading circuit 60, besides the display/operation panel 3 in the front operation box 2*d*. The output of the infrared light reception diode 60*a* is connected to the second microcomputer 45 through the amplification/demodulation level converting circuit 60*b*. In front of the infrared light reception diode 60*a*, there is the plastic member of the front operation box 2*d*. Usually, infrared rays pass through a thin plastic material.

The serviceman first turns on the power switch 15 of the washing machine at user's home. When the power switch 15 is turned on, the first microcomputer 35 examines the flash memory write flag stored in the EEPROM 40. If the flag is not set in the EEPROM 40, the first microcomputer 35 transmits a data reception command {data-reception} to the second microcomputer 45 through the two-way communication circuit. This flag is reset at the time of factory shipment. After receiving the data reception command {data-reception}, the second microcomputer 45 performs input acceptance processing for accepting data from the demodulation level converting circuit 60*b*.

Then, the serviceman holds the carried display/operation panel layout data writer 62 so that the infrared LED 62*h* in the writer 62 is placed in front of the infrared light reception diode 60*a*. The serviceman selects one of the display/operation panel layout data by the data selection switch 62*c* and presses the transmission start button 62*d*. When the transmission start button 62*d* is pressed, the control circuit 62*a* supplies the serial conversion/modulation circuit 62*f* with first predetermined data showing the start of data transmission, succeedingly the selected display/operation panel layout data in the data memory, and last data showing the termination of the data transmission. The data are converted into serial data and carrier-modulated sequentially by the serial conversion/modulation circuit 62*f*, and the infrared LED 62*h* is driven by the infrared LED driving circuit 62*g*. The modulated infrared light passes through the plastic member of the front operation box 2*d* and is received by the infrared light reception diode 60*a*. The received infrared light is converted into voltage by the infrared light reception diode 60*a* and amplified/demodulated by the demodulation level converting circuit 60*b* so as to be converted into original serial data. This serial data is read into the external data input portion 45*c* of the second microcomputer 45. When the external data input portion 45*c* receives the data transmission start data, the second microcomputer 45 then moves to processing for writing the next received display/operation panel layout data into the flash memory 61 by use of the flash memory input/output portion 45*b*-9. Thus, the display/operation panel layout data are written and stored in the flash memory 61 sequentially. This processing is continued until the data transmission termination data is received. If one display/operation panel layout data has been received, the second microcomputer 45 leaves the flash memory write routine, and sends the first microcomputer 35 a write termination command as soon as writing in the flash memory is terminated. The first microcomputer 35 receiving the termination command sets the above-mentioned write flag. After that, when the power switch is turned on, display processing is performed directly without sending any data reception command (any processing of input acceptance). Incidentally, the reason why the infrared output is carrier-modulated is to prevent a malfunction caused by sunlight when writing is performed outdoors.

If writing is terminated, the power of the washing machine is once switched off. Then, if the power is turned on again, the display/operation panel layout data written thus is displayed on the display/operation panel 3. The following operation is similar to the operation when one layout has been selected by the selection switch 16 in the first embodiment.

Here, description will be made about a rewriting method in the case where the user confirms the written panel layout but then hopes to change the panel layout into another one. As one of initial setting processing when the power is turned on, the second microcomputer 45 executes processing for accepting data from the demodulation level converting circuit 60*b* for a short time, for example, for 300 mS, and judging a rewrite request from the display/operation panel layout data writer 62. That is, when the power is turned on, the display/operation panel layout data writer 62 is attached to the washing machine in the same manner as mentioned above, and the rewrite request button 62*e* is pressed to transmit rewrite request infrared data to the second microcomputer 45. If the second microcomputer 45 accepts the rewrite request, the second microcomputer 45 does not perform normal processing but generates a buzzer sound to inform the serviceman of the acceptance of the rewrite request. At the same time, the second microcomputer 45 clears the flash memory 61, and generates a buzzer sound again. After that, the second microcomputer 45 performs the aforementioned input acceptance processing for accepting data from the amplification/demodulation level converting circuit 60*b*. (The same processing as that when a data reception command has been received from the first microcomputer 35.) After that, the serviceman may select another display/operation panel layout data and press the data transmission start button 62*d* so as to write new data as mentioned above.

Figure 28:
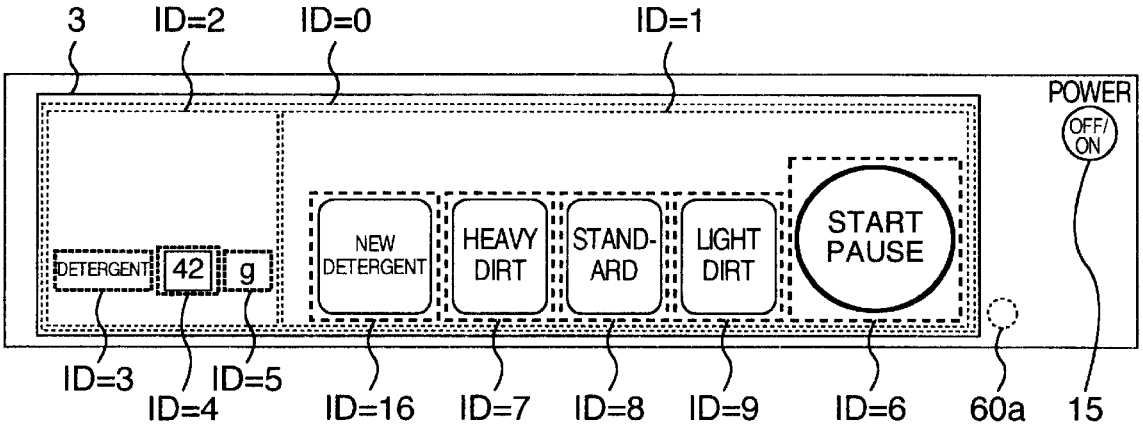
FIG. 28 is a view showing a new-detergent-matched display/operation panel layout.
Figure 29:
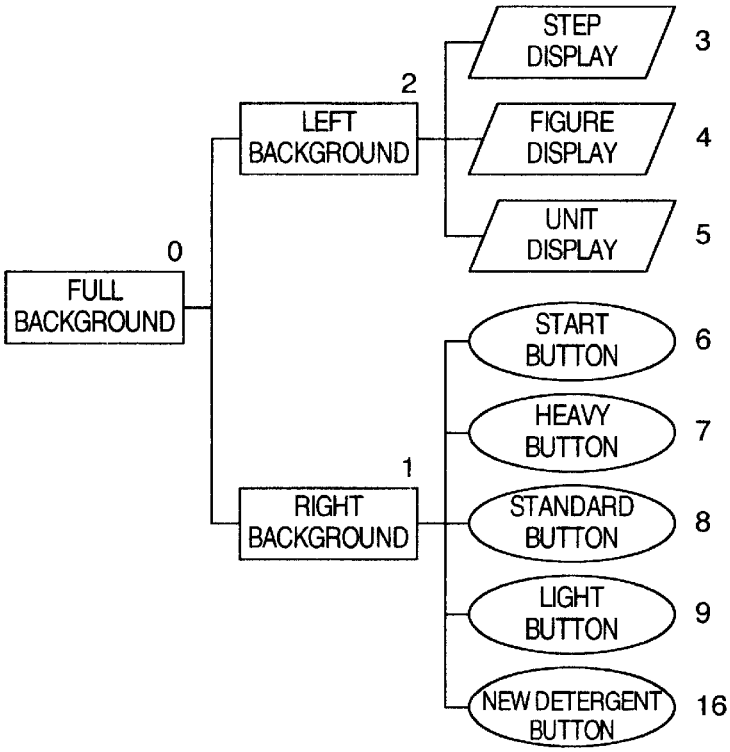
FIG. 29 is a tree structured diagram showing the new-detergent-matched display/operation panel layout.

FIG. 28 shows a display/operation panel layout in the case where new detergent is put on the market and there are particularly added washing steps in the washing course which is optimum for washing with the new detergent. In this layout, a new detergent button is added to the first display/operation panel layout (FIG. 13). FIG. 29 shows a tree structure of the layout. A button display image part item "new detergent" is added with ID=16. As an action script at ON, {wash 8 min time-limit-1.2–1.2 rotation-speed-150 rpm} is described.

This tree structure data, respective display image part item data of the tree structure, and dot picture image data of the respective display image part items are written in the flash memory 61 in the washing machine by means of the display/operation panel layout data writer 62 as described above. Since display and operation are similar to those in the first embodiment, the description thereof will be omitted. Here, only the operation in the "new detergent" button will be described.

Step time, and, forward or backward rotating/driving time, rest time and rotation speed of rotor blades 7 in a washing or rinsing step; and step time, required driving time for each dehydrating rotation speed and rotation speed in a dehydrating step; are stored as sequence data for each washing step (heavy dirt wash, standard wash, and light dirt wash) in the washing step controller of the first microcomputer 35 in advance. The forward or backward rotating/driving time and the rest time of the rotor blades 7 in the washing or rinsing step is called a time limit. Normally, the forward rotating time is set to be equal to the backward rotating time. Accordingly, the time limit may be expressed by a combination of the driving time and the rest time. The time limit of 1.2–1.2 means driving for 1.2 seconds and taking a rest for 1.2 seconds. The washing or rinsing step is executed by performing rotation forward and backward repeatedly in accordance with the time limit. In this case, the step time may be expressed by the number of times of such repetition. In the first embodiment, if the first microcomputer 35 receives a command {standard-wash}, the first microcomputer 35 drives the PWM inverter circuit 39 on the basis of the above-mentioned step time, time limit and rotation speed stored as sequence data in advance, so that the DC brushless motor 9*a* is rotated. Thus, washing is executed. In this embodiment, the second microcomputer 45 sends the step time, the time limit and the rotation speed as commands so as to allow the first microcomputer 35 to carry out washing which is not stored as sequence data. This is realized, as described above, by sending the first microcomputer 35 an action script of a button item with the step time, the time limit and the rotation speed as parameters, together with the command {wash}.

Although only the washing step is changed to match new detergent in this description, not to say, it is possible to change the rinsing step or the dehydrating step by describing action scripts in the same manner. For example, action scripts {rinse 4 min time-limit-1.2–0.8 rotation-speed-120 rpm} and {dehydrate 4 min 10 sec 150 rpm 30 sec 200 rpm 200 sec 800 rpm} are described to follow the action script {wash 8 min time-limit-1.2–1.2 rotation-speed-150 rpm}. Incidentally, if there is only washing description as the action script, sequence data stored in advance, for example, those sequence data for the rinsing step and the hydrating step of the standard washing are used.

Figure 30:
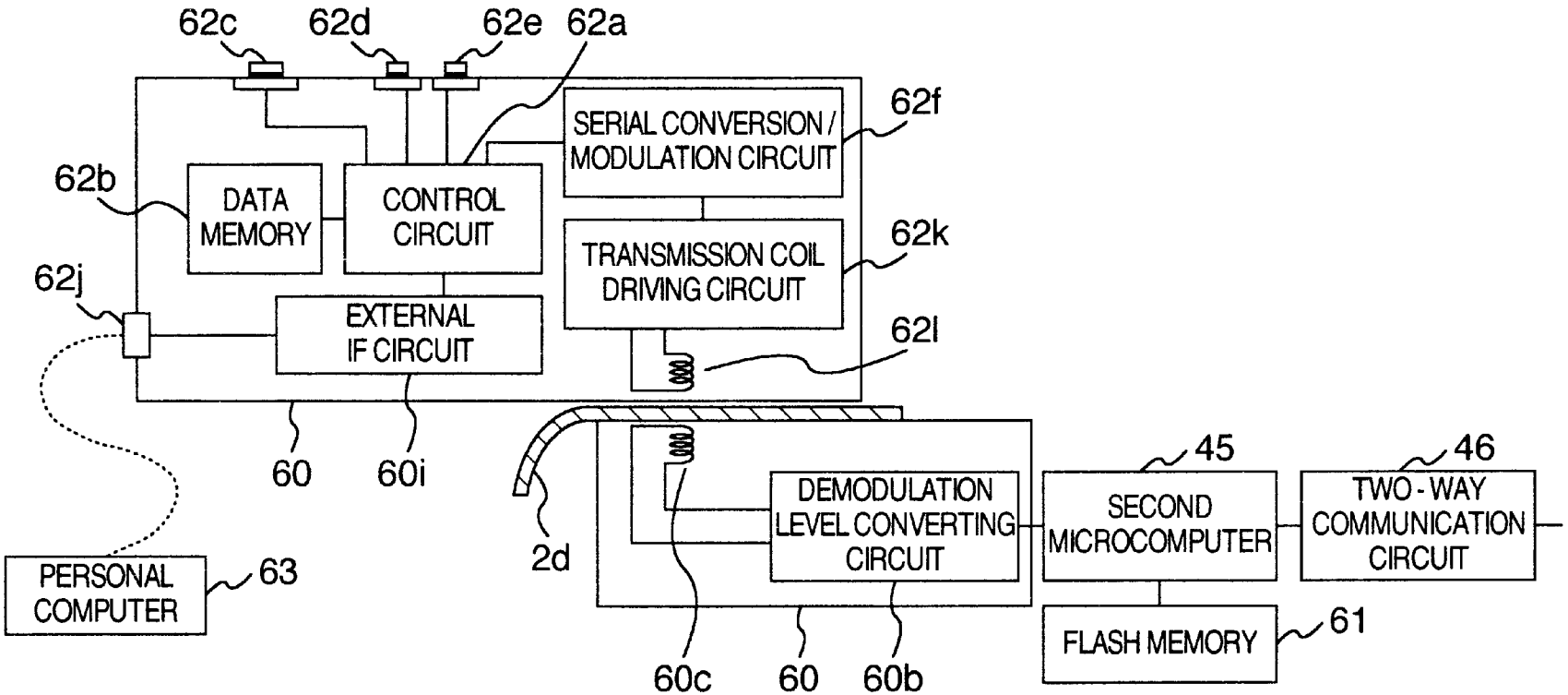
FIG. 30 is a detailed diagram showing a second embodiment of a display/operation panel layout data writer.

FIG. 30 shows another embodiment of the display/operation panel layout data writer 62 and the non-contact reading circuit 60. In FIG. 30, parts the same as those in FIG. 26 are referenced correspondingly. There is a fear that an error may occur in information transmission by means of light due to detergent adhering stain. This embodiment copes with this error. Non-contact data reading is performed by electromagnetic induction. The display/operation panel layout data writer 62 is further constituted by a transmission coil driving circuit 62*k* and a transmission coil 62*l*. In the washing machine, the reference numeral 60*c* represents a reception coil. Display/operation panel layout data is converted into serial data, and carrier-modulated, so that a modulated current is made to flow into the transmission coil 621. This modulated current generates a voltage in the reception coil 60*c*. This voltage is demodulated by the amplification/demodulation level converting circuit 60*b*. The demodulated serial data is level-converted and supplied to the second microcomputer 45. The second microcomputer 45 stores the data into the flash memory 61. Since the other operation is similar to that in the above-mentioned embodiment in FIG. 28, the description thereof will be omitted.

Display is made on the display/operation panel 3 on the basis of the display/operation panel layout data stored in the flash memory 61. Since the following operation is similar to that in the description of the first embodiment, the description thereof will be omitted.

As has been described above, according to this embodiment, a new display/operation panel layout or a new washing step can be introduced without replacing the first microcomputer 35 for controlling the washing machine and the second microcomputer 45 for controlling the display/operation panel 3, with new microcomputers. In addition, the ROM capacity of the second microcomputer 45 can be reduced, so that the second microcomputer 45 can be arranged at a low cost. Further, the serviceman can ask user's preference while displaying various display/operation panel layout data at user's home. Thus, the serviceman can store one of the display/operation panel layout data selected by the user into the flash memory 61. Accordingly, it is possible to select a display/operation panel 3 and an operation method that the user judges as most convenient to use.

Even if the display/operation panel layout data becomes inconvenient to use due to user's aging later, the use may replace the existing display/operation panel layout data with another display/operation panel layout data so that the user's convenience to use can be improved. In addition, when new detergent or new clothing is put on the market, it is possible to introduce new washing steps which match the new detergent or clothing.

Incidentally, although the above description was made about the operation in which data for one display/operation panel layout were written into the flash memory 61, the present invention is not limited thereto. For example, the display/operation panel layout data in the first embodiment may be written in the ROM of the microcomputer 45 in advance, so that only a minimum requirement of data such as a tree structure required for a new display/operation panel layout may be written later while using the data written previously (particularly the dot picture image data displayed actually). Thus, not only is it possible to shorten the write time but also it is possible to reduce the capacity of the expensive flash memory 61.

Figure 31:
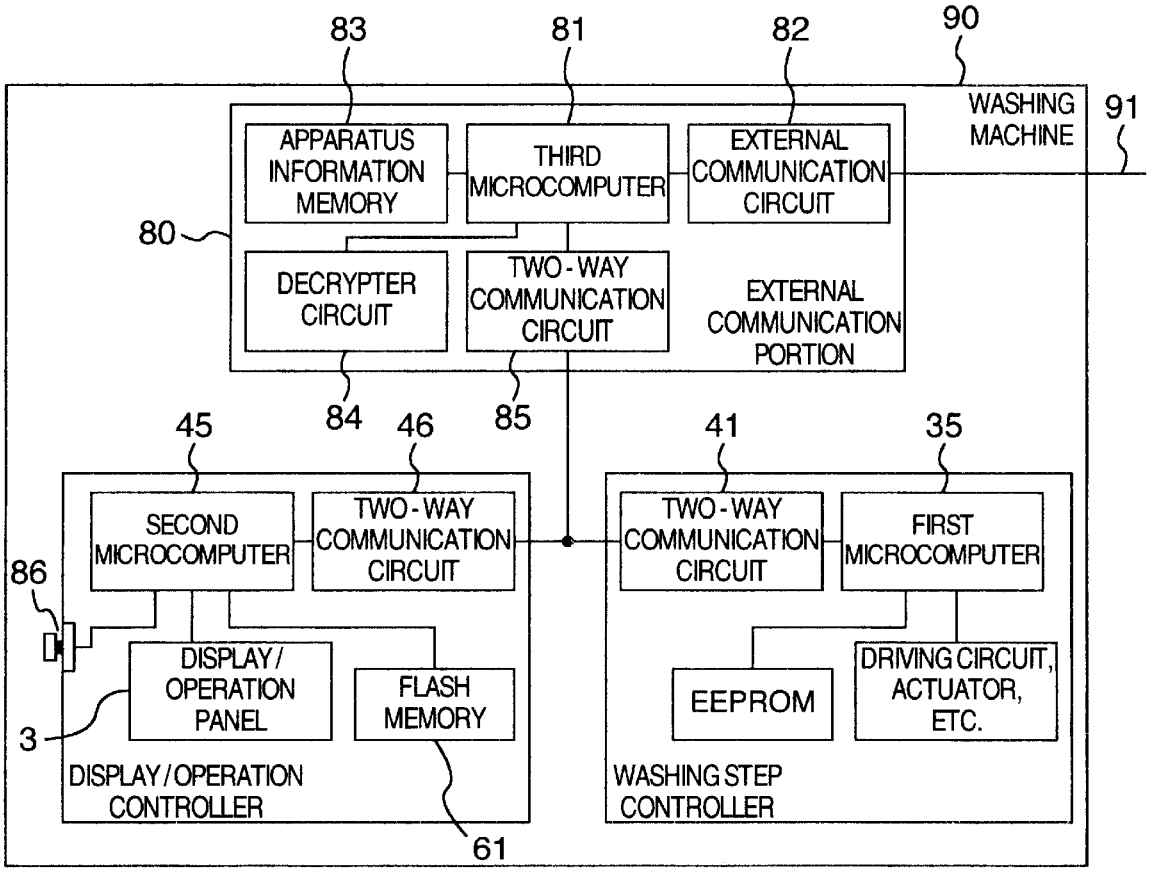
FIG. 31 is a diagram showing a washing machine according to a third embodiment of the present invention.

FIG. 31 shows a circuit block configuration of a third embodiment of the present invention. In addition to the display/operation controller and the washing step controller connected through the two-way communication circuit in the first embodiment, an external communication portion 80 having a two-way communication circuit is added so that the respective two-way communication circuits are connected like a star. The external communication portion 80 is constituted by a third microcomputer 81, an external communication circuit 82, an apparatus information memory 83, a decrypter circuit 84, and a two-way communication circuit 85. The apparatus information memory 83 stores the kind, function, model and serial number of the washing machine. The decrypter circuit 84 performs decryption by use of the aforementioned model and serial number as keys. The two-way communication circuit 85 is similar to that in each of the first and second embodiments. The external communication circuit 82 makes communication with the outside of the washing machine. For example, the external communication circuit 82 is a power line communication circuit for making communication with the outside through a commercial power supply line for household appliances, or a wireless communication circuit using a radio wave or an infrared ray. Further, a serial number display switch 86 is provided in the display/operation controller. When the serial number display switch 86 is pressed, the serial number is displayed on the display/operation panel 3. Incidentally, the decryption processing of the decrypter circuit 84 may be performed by the software of the third microcomputer 81.

Figure 32:
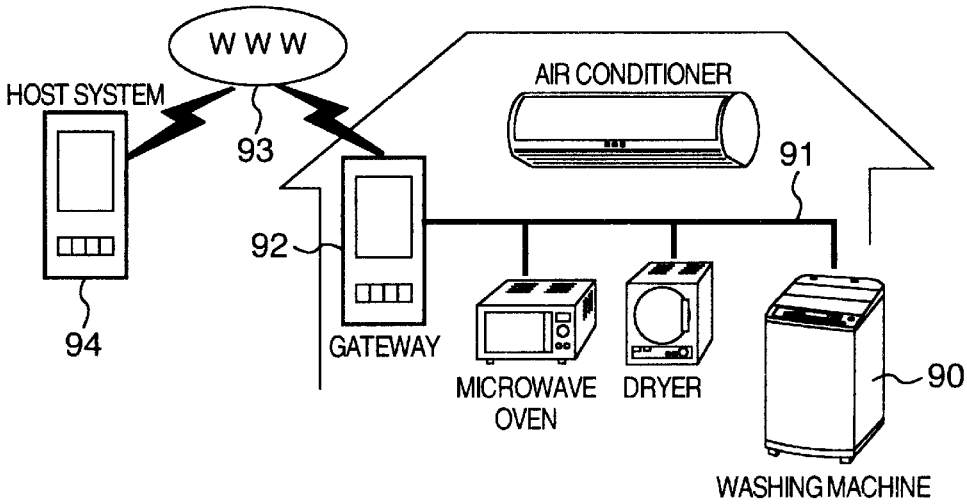
FIG. 32 is a view showing a connection of the washing machine to a domestic LAN.

FIG. 32 shows the state where the washing machine 90 in the third embodiment has been connected to a domestic local area network (hereinafter abbreviated to "LAN") 91 through the external communication circuit 82.

The washing machine 90 is connected to a gateway 92 through the domestic LAN 91. The gateway 92 is connected directly to Internet 93 so as to transmit/receive information to/from a host system 94 which is also connected to the Internet 93. Incidentally, domestic LANs are classified into various forms according to whether they are wireless or wired, or what communication system they use. Any form may be adopted in this embodiment.

The host system 94 is a system having a predetermined homepage opened on the internet 93 and storing various kinds of information such as appliance information of household appliances and service information. Specifically, in the description of this embodiment, as the service information for every kind of washing machine, there are stored washing machine models, serial numbers sold out for every model, a plurality of changeable display/operation panel layout data for every model, and image data for displaying the display/operation panel layouts, or display/operation panel layout data capable of operating an optimum washing step for every model using new detergent put on the market. Not to say, washing machine manufacturers can gain access to the host system 94 so as to update such data. In this embodiment, description will be made about a method in which a user gains access to the host system 94 connected to the Internet 93 so as to download new display/operation panel layout data or display/operation panel layout data capable of operating new washing steps and introduce the display/operation panel layout data into the user's own washing machine.

Figure 33:
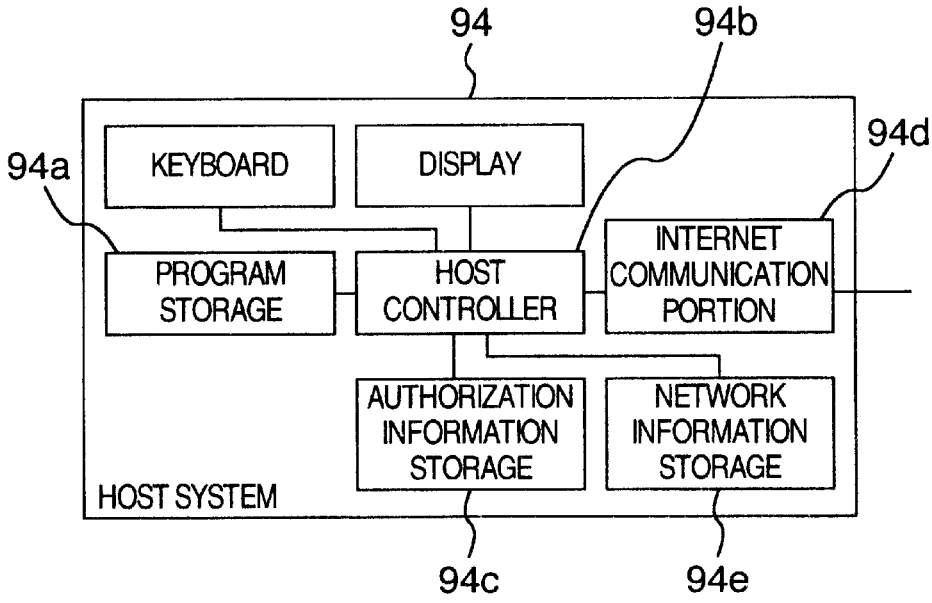
FIG. 33 is a block diagram showing a host system.

The host system 94 has a database function, a communication function and an update function. The host system 94 is constituted by a host controller 94*b*, a display, a keyboard, an authorization information storage 94*c*, a network information storage 94*e*, a program storage 94*a*, and an Internet communication portion 94*d*, as shown in FIG. 33.

The program storage 94*a* stores a program for controlling the host system 94. The host controller 94*b* controls the operation of the host system 94 in accordance with the program stored in the program storage 94*a*.

The authorization information storage 94*c* stores registration information for recognizing and identifying a partner when the partner exchanges information with the host system 94 on the Internet 93 through the Internet communication portion 94*d*. This storage is required for keeping security of information on the network. The information stored in the authorization information storage 94*c* includes information about users, informants, update, and so on. Persons using the network are registered and stored as users' information. Disclosures to users and providers are stored as information service information. In addition, disclosure forms are stored. Registration information such as what information is transferred to what address (on the Internet) is stored as transfer destination information. Registration information as to whether information provided as update information may be used for users or providers to update or not is stored.

The Internet information storage 94*e* stores character information, image information, sound information, program information, or the like, which are provided on the Internet 93. Here, the display/operation panel layout data in this embodiment are stored by the manufacturer.

Household appliances such as an air conditioner, a microwave oven, a dryer, etc. other than the washing machine 90 are also connected to the gateway 92 through the domestic LAN 91. The gateway 92 performs a function as follows. That is, the gateway 92 requests the host system 94 of various kinds of information such as display/operation panel layout data in accordance with requests from the household appliances. The gateway 92 receives and stores the information sent from the host system 94, and gives the information to the household appliances issuing the requests. Thus, to the household appliances, the gateway 92 becomes a window to the outside world.

Figure 34:
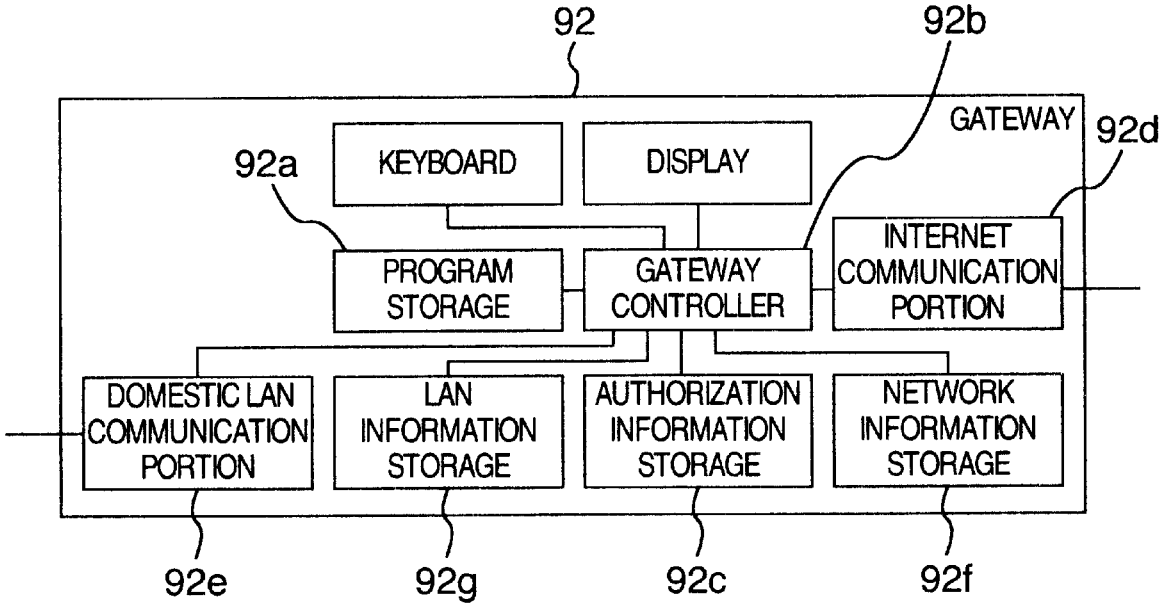
FIG. 34 is a block diagram showing a gateway.

The gateway 92 has a database function, a communication function and an update function. The gateway 92 is constituted by a gateway controller 92*b*, a display, a keyboard, an authorization information storage 92*c*, a network information storage 92*f*, a program storage 92*a*, an Internet communication portion 92*d*, a domestic LAN communication portion 92*e*, and a LAN information storage 92*g*, as shown in FIG. 34.

The program storage 92*a* stores a program for controlling the gateway 92. The gateway controller 92*b* controls the operation of the gateway 92 in accordance with the program stored in the program storage 92*a*.

The authorization information storage 92*c* recognizes and identifies the host system 94 when information is exchanged on the Internet 93 through the Internet communication portion 92*d*. This storage is required for keeping security of information on the network. The information stored in the authorization information storage 92*c* includes information about the host system 94 on Internet connection, users, update, and so on.

Through the domestic LAN communication portion 92*e*, the gateway 92 is connected to the respective household appliances which are connected to the domestic LAN 91. Then, the gateway 92 receives information required by the respective household appliances from the host system 94. The gateway 92 stores the information into the network information storage 92*f* and displays the information on the display. In addition, the gateway 92 has a function to select the displayed information, and provides the household appliances with information requested by the household appliances on the basis of the selected information.

Processing for registering a household appliance in the gateway 92 will be described in the case where the washing machine 90 in this embodiment as the household appliance is newly connected to the domestic LAN 91. First, an apparatus information request is transmitted from the gateway 92 to the washing machine 90. In response to the apparatus information request, the washing machine 90 transmits its own apparatus information. Thus, the gateway 92 can identify what apparatus, that is, the washing machine 90 in this case, has been connected to the domestic LAN 91. The request from the gateway 92 is transmitted to the third microcomputer 81 through the external communication circuit 82. In response to the request, the microcomputer 81 reads the apparatus information from the apparatus information memory 83 and transmits the apparatus information to the gateway 92 through the external communication circuit 82. When the gateway 92 receives the apparatus information from the washing machine 90, the gateway 92 stores the apparatus information into the LAN information storage 92*g* and performs apparatus registration of this household appliance connected newly.

In the host system 94 disposed on World Wide Web (hereinafter referred to as "WWW") of the Internet 93, a plurality of display/operation panel layouts for the washing machine 90 are stored and classified by model, as described previously. The washing machine user gains access to the homepage of the host system 94 through the gateway 92 by a browser program, and reads available display/operation panel layouts on the basis of the model of the user's own washing machine. Then, the user selects one of the display/operation panel layouts which meets the user's preference or necessity. To download the selected display/operation panel layout data from the host system 94, the user first transmits serial number data to the host system 94. The serial number is displayed on the display/operation panel 3 if the user presses the serial number display switch 86 of the washing machine 90. The user confirms the serial number and transmits the serial number to the host system 94. The host system 94 encrypts the desired display/operation panel layout data by use of the serial number and the model as keys, and transmits the encrypted display/operation panel layout data to the user. The encrypted display/operation panel layout data is once accumulated in the network information storage 92*e* of the gateway 92, and thereafter transferred to the external communication means 80 of the washing machine 90 through the domestic LAN 91 in response to a request from the washing machine 90. The external communication means 80 decrypts the encrypted display/operation panel layout data by means of the decrypter circuit 84 on the basis of the serial number and the model stored in the apparatus information memory 83, and thereafter transmits the decrypted display/operation panel layout data to the second microcomputer 45 through the two-way communication means 85. The reason why the display/operation panel layout data is encrypted with the serial number is: 1) to authorize the person gaining access as the person using the washing machine; and 2) to protect the washing machine with a power or heat source from malicious modification by others so as to ensure security and reliability. The reason why the model is also used as a cipher key is to confirm the model of the washing machine in case the user mistakes the model of the user's own washing machine for another model. Such double precautions allow the user to select a preferable display/operation panel layout at ease.

The second microprocessor 45 stores the decrypted display/operation panel layout data from the two-way communication portion 45*a* into the flash memory 61 through the flash memory input/output portion 45*b*-8 in the same manner as in the second embodiment. After that, image data in the newly updated display/operation panel layout data is sent to the display on the basis of the layout so as to display display image parts such as various kinds of figures, characters, washing progress status, operation buttons, etc. Since this operation is similar to that in each of the first and second embodiment, the description thereof will be omitted.

As has been described above, the washing machine user can freely select a preferable one from a plurality of display/operation panel layout data accumulated in the host system, download the selected data safely, and write the downloaded data into the washing machine, so as to use the new data for real display/operation and for execution of the work of washing. Thus, the convenience of use is improved. Particularly, there is an effect to cope with the difficulty in operation caused by failure in eyesight, tremble of hands, and so on, because of aging. In addition, the range of selection of panel layout data can be made wider than that in each of the first and second embodiments. Further, latest display/operation panel layout data improved in convenience of use can be put into practical use successively.

As has been described above, in order to make the present invention clear, the operation of the present invention was described with the first to third microcomputers having different functions respectively. However, the present invention is not limited to this. For example, all the functions can be performed by a single microcomputer with the advance of the microcomputer in performance (speed and memory capacity).

The present invention was described above with a full automatic washing machine the length of which is longer than the width and in which the rotation shaft of the washing and dehydrating tub was vertical, by way of example. However, the present invention is not limited to this. It is obvious that the present invention is also applicable to a so-called drum-type washing machine in which the rotation shaft of the washing and dehydrating tub is horizontal.

Although the present invention was described above in terms of a washing machine, the present invention is not limited to this. According to the configuration of the present invention, users are allowed to freely change the display/operation also in other household appliances (such as air conditioners, clothing dryers, dishwashers, etc.) which are complicated in display/operation as functions increase. Thus, the present invention is effective in the point that the degree of freedom in selecting operation is increased, and an apparatus easy for everyone to use is provided. Particularly, the present invention is effective for aged persons who become poor in eyesight or unsteady in hands because of aging. In addition, functions which can be newly introduced and an operation method thereof can be introduced freely.

We claim:

1. A washing machine comprising:

display means in which a transparent pressure-type touch panel is mounted on a display surface; and storage means for storing a plurality of display image parts including at least a start button for instructing a start of washing and a plurality of display arrangement structures in which combinations of said display image parts and arrangements of said display image parts including said start button on said display surface are described; and selection means for selecting at least one display arrangement structure from said plurality of display arrangement structures;

wherein a plurality of said display image parts including at least said start button are disposed and displayed by said display means on the basis of said at least one display arrangement structure optionally selected by said selection means so as to form display/operation means which enables display and operation/instruction by depression, and actions of said washing machine can be set by said display/operation means.

2. A washing machine according to claim 1, wherein said plurality of display arrangement structures describe a plurality of tree structures designating dependent relations and parallel relations among said display image parts.

3. A washing machine according to claim 1, wherein information for display positions on said display surface of said display means, sizes, dot picture image data and start addresses of said dot picture image data are stored as information for display corresponding to said display image parts.

4. A washing machine according to claim 1, wherein information indicating actions are stored corresponding to said plurality of said display image parts.

5. A washing machine according to claim 1, wherein information for display positions on said display surface of said display means, sizes, dot picture image data and start addresses of said dot picture image data are stored as information for display corresponding to said display image parts, and wherein information indicating actions are stored as information for actions along with said information for display corresponding to display image parts the depression areas of which are assigned on said pressure-type touch panel.

6. A washing machine according to claim 1, further comprising:

electrically rewritable storage means as said storage means for storing said plurality of display image parts and said plurality of display arrangement structures; and data communication means for taking, into said storage means, display image parts or display arrangement structures transmitted from the outside of said washing machine.

7. A washing machine according to claim 6, wherein said data communication means is non-contact data reading means for reading data in a non-contact manner.

8. A display/operation panel comprising:

display means in which a transparent pressure-type touch panel is mounted on a display surface;

storage means for storing a plurality of display image parts including at least a start button for instructing a start and a plurality of display arrangement structures in which combinations of said display image parts and arrangements of said display image parts including said start button on said display surface are described; and selection means for selecting at least one display arrangement structure from said plurality of display arrangement structures;

wherein a plurality of said display image parts including at least said start button are disposed and displayed by said display means on the basis of said at least one display arrangement structure optionally selected by said selection means so as to enable display and operation/instruction by depression.

9. A household appliance comprising:

display means in which a transparent pressure-type touch panel is mounted on a display surface;

storage means for storing a plurality of display image parts including at least a start button for instructing a start and a plurality of display arrangement structures in which combinations of said display image parts and arrangements of said display image parts including said start button on said display surface are described; and selection means for selecting at least one display arrangement from said plurality of display arrangement structures;

wherein a plurality of said display image parts are disposed and displayed by said display means on the basis of said at least one display arrangement structure optionally selected by said selection means so as to form display/operation means which enables display and operation/instruction by depression, and actions can be set by said display/operation means.

* * * * *